US012446635B2

(12) United States Patent
Ukita et al.

(10) Patent No.: US 12,446,635 B2
(45) Date of Patent: Oct. 21, 2025

(54) PROTECTION DEVICE

(71) Applicant: Daicel Corporation, Osaka (JP)

(72) Inventors: Shinichiro Ukita, Tokyo (JP); Shunji Nakai, Tokyo (JP); Masayuki Yamazaki, Tokyo (JP)

(73) Assignee: Daicel Corporation, Osaka (JP)

( * ) Notice: Subject to any disclaimer, the term of this patent is extended or adjusted under 35 U.S.C. 154(b) by 0 days.

(21) Appl. No.: 18/388,640

(22) Filed: Nov. 10, 2023

(65) Prior Publication Data

US 2024/0285000 A1 Aug. 29, 2024

Related U.S. Application Data

(63) Continuation of application No. PCT/JP2022/019807, filed on May 10, 2022.

(30) Foreign Application Priority Data

May 12, 2021 (JP) ..... 2021-081036

(51) Int. Cl.
*A41D 13/015* (2006.01)
*A42B 3/32* (2006.01)

(52) U.S. Cl.
CPC ..... *A41D 13/015* (2013.01); *A42B 3/322* (2013.01)

(58) Field of Classification Search
CPC ..... A41D 13/05; A41D 13/015; A42B 3/32; A42B 3/322; A42B 3/324; A42B 3/326; A42B 3/328
See application file for complete search history.

(56) References Cited

U.S. PATENT DOCUMENTS 3,026,525 A * 3/1962 Gyorfy ..... A42B 3/322 2/202
3,514,787 A * 6/1970 Kennedy, Jr. ..... A42B 3/322 D29/104

(Continued)

FOREIGN PATENT DOCUMENTS

CN 210539129 U 5/2020
DE 2717234 A1 11/1978

(Continued)

OTHER PUBLICATIONS

International Search Report issued in the corresponding Application No. PCT/JP22/019807, mailed Jul. 12, 2022.

(Continued)

*Primary Examiner* — Bao-Thieu L Nguyen
(74) *Attorney, Agent, or Firm* — Morgan, Lewis & Bockius LLP

(57) ABSTRACT

A protection device worn on a human body and protects a head of the human body includes a base portion attachable to the human body, and a protection unit having a honeycomb structure or a bellows structure, held by the base portion, and being reversibly switchable between a folded orientation in which the protection unit is folded and an unfolded orientation in which the protection unit is unfolded from the folded orientation and thus the protection unit covers the head of the human body, the protection unit being provided with a fixed end fixed to the base portion and a free end not fixed to the base portion, the protection unit is folded in a state where the free end is close to the fixed end, and the protection unit is unfolded around the head while the free end separates from the fixed end.

18 Claims, 27 Drawing Sheets

(56) References Cited

U.S. PATENT DOCUMENTS

| | | | | |
|---|---|---|---|---|
| 3,991,422 | A * | 11/1976 | Saotome | A42B 3/322 2/410 |
| 4,291,417 | A * | 9/1981 | Pagano | A42B 1/201 2/202 |
| 4,607,397 | A * | 8/1986 | Laxo | A42B 3/322 2/410 |
| 5,896,590 | A * | 4/1999 | Fleisch | A42B 3/0473 224/186 |
| 6,256,796 | B1 * | 7/2001 | Fleming | A42B 1/004 2/244 |
| 10,001,346 | B2 | 6/2018 | Augustine et al. | |
| 10,357,072 | B2 * | 7/2019 | Chong | A42B 1/205 |
| 11,786,406 | B2 * | 10/2023 | Huh | B23K 9/322 2/8.5 |
| 2010/0031426 | A1 * | 2/2010 | Lapham | A42B 3/322 2/411 |
| 2012/0048320 | A1 * | 3/2012 | Hardie | E04H 15/36 135/129 |
| 2012/0255105 | A1 * | 10/2012 | Turner | A41D 13/015 2/455 |
| 2017/0000206 | A1 * | 1/2017 | Chong | A42B 1/205 |
| 2017/0277158 | A1 * | 9/2017 | Hyde | A01K 13/006 |
| 2019/0142100 | A1 * | 5/2019 | Shiffer | G09F 21/02 2/417 |
| 2020/0288808 | A1 * | 9/2020 | Segal | A42B 3/069 |
| 2021/0177687 | A1 * | 6/2021 | Lamson | A63B 69/18 |
| 2022/0104574 | A1 * | 4/2022 | Varga | A42B 3/124 |
| 2022/0192308 | A1 * | 6/2022 | Herperger | A42B 3/122 |
| 2022/0273067 | A1 * | 9/2022 | Bensaoud | A42B 3/0486 |
| 2023/0248105 | A1 * | 8/2023 | Varga | A42B 3/322 2/417 |
| 2024/0260703 | A1 * | 8/2024 | Sholev | A42B 3/322 |

FOREIGN PATENT DOCUMENTS

| | | | |
|---|---|---|---|
| IT | PD20120335 | A1 | 5/2014 |
| JP | H11-511820 | A | 10/1999 |
| JP | 2014-079440 | A | 5/2014 |
| KR | 10-2010-0060458 | A | 6/2010 |
| WO | 2021/013407 | A1 | 1/2021 |

OTHER PUBLICATIONS

Written Opinion of the International Search Authority issued in the corresponding Application No. PCT/JP22/019807, mailed Jul. 12, 2022.

Extended European Search Report issued in corresponding European Patent Application No. 22807469.6, dated Apr. 9, 2025.

* cited by examiner

PROTECTION DEVICE

TECHNICAL FIELD

The present invention relates to a protection device for a human body.

BACKGROUND ART

Patent Document 1 discloses a human body protection device that is worn on a human body and protects a specific part of the human body by inflating and deploying an airbag and surrounding the specific part of the human body with the airbag when a flame generated around the human body is detected. Patent Document 2 discloses a device that is attached to the neck of a soldier and prevents brain damage due to blast by inflating a chamber when air pressure equal to or higher than a threshold value is sensed by a sensor.

CITATION LIST

Patent Documents

Patent Document 1: JP 2014-79440 A
Patent Document 2: U.S. Pat. No. 10,001,346

SUMMARY

Technical Problem

As in Patent Documents 1 and 2, in the system in which the airbag or the chamber is inflated by supplying air at the time of activation, it is difficult to return the airbag or the chamber to the state before activation after the airbag or the chamber is activated, and thus there is a problem in that the device cannot be repeatedly used.

Additionally, in order to instantaneously deploy the airbag or the chamber by supplying air to the airbag or the chamber, it is conceivable that air generated by instantaneously burning powder is supplied or accumulated gas is instantaneously released. However, this method has a problem in that the device itself becomes bulky and the weight thereof increases.

The technique of the present disclosure has been made in view of the circumstances above, and an object thereof is to provide a protection device that protects the head of the human body by using a protection unit that is reversibly switchable between a folded orientation and an unfolded orientation.

Solution to Problem

To solve the problem above, a protection device according to an aspect of the present disclosure is a protection device that is worn on a human body and protects at least a head of the human body, the protection device including a base portion attachable to the human body; and a protection unit having a honeycomb structure or a bellows structure, held by the base portion, and being reversibly switchable between a folded orientation in which the protection unit is folded and an unfolded orientation in which the protection unit is unfolded from the folded orientation and thus the protection unit covers the head of the human body, the protection unit being provided with a fixed end fixed to the base portion and a free end not fixed to the base portion. In the folded orientation, the protection unit is folded in a state where the free end is close to the fixed end, and at the time of switching from the folded orientation to the unfolded orientation, the protection unit is unfolded around the head while the free end separates from the fixed end.

The protection unit is brought into the unfolded orientation by elastic force of an elastic member, and is folded from the unfolded orientation against the elasticity and thus can change the orientation to the folded orientation. The protection device may further include a lock portion configured to lock the protection unit in the folded orientation against the elastic force; and a trigger portion configured to release lock of the protection unit by the lock portion and thus cause the protection unit to unfold.

The protection device may include a detection unit configured to detect a state of the human body or a state around the human body; and a control unit configured to acquire a detection result by the detection unit and control the trigger portion to release the lock by the lock portion when the detection result satisfies a predetermined condition.

The protection device may further include a drive portion configured to cause the protection unit to unfold by driving the free end of the protection unit in the folded orientation and thus separating the free end from the fixed end.

The protection device may include a detection unit configured to detect a state of the human body or a state around the human body; and a control unit configured to acquire a detection result by the detection unit and control the drive portion to cause the drive portion to operate when the detection result satisfies a predetermined condition.

At least the free end of the protection unit may rotate about a straight line at a predetermined position as a rotation center to reversibly change the orientation between the folded orientation before activation and the unfolded orientation after activation.

When the protection device is worn on the human body, the base portion may be disposed on a lower side of the head, and the protection unit may be brought into the unfolded orientation after activation from the folded orientation before activation by upward movement of the free end during activation.

The protection device may further include a restriction portion including one end connected to a side of the free end of the protection unit and the other end connected to the base portion, the restriction portion being configured to restrict a moving distance of the free end.

The protection unit may be formed of a buffer material having a buffering function, and the buffer material may have a bellows shape in which a rib is attached to a crest portion of the buffer material. The rib may be bridged between guide rails disposed on left and right side surfaces of the base portion and provided with grooves, and left and right end portions of the rib may be slidably attached to the grooves.

The detection unit may include at least one sensing unit selected from an acceleration sensor, a gyro sensor, a positioning device, a camera, a radar, a LIDAR, and a three-dimensional scanner.

The base portion may be used in a state where a lower surface thereof is in contact with shoulders of the human body and the base portion is disposed around a neck of the human body.

The protection unit may be formed of a buffer material having a buffering function, and the buffer material may also cover a face of the human body when the protection unit is activated and brought into the unfolded orientation.

The protection device may further include a fixing portion configured to fix the base portion to the human body.

The protection device may further include a cover portion configured to cover a surface of the protection unit that is located on a side of the head, when the protection unit is brought into the unfolded orientation.

Advantageous Effects of Invention

According to the present disclosure, a protection device that protects the head of a human body by using a protection unit that is reversibly switchable between a folded orientation and an unfolded orientation can be provided.

DESCRIPTION OF EMBODIMENTS

First Embodiment

Hereinafter, a protection device according to embodiments of the present disclosure will be described with reference to the drawings. It should be noted that the configurations and the combinations thereof in the embodiments are only examples, and the configurations may be added, omitted, substituted, or otherwise modified as appropriate within a scope that does not depart from the spirit of the present disclosure. The present disclosure is not limited by the embodiments and is limited only by the claims. In addition, each of the embodiments disclosed in the present specification can be combined with any other feature disclosed in the present specification.

Figure 1:
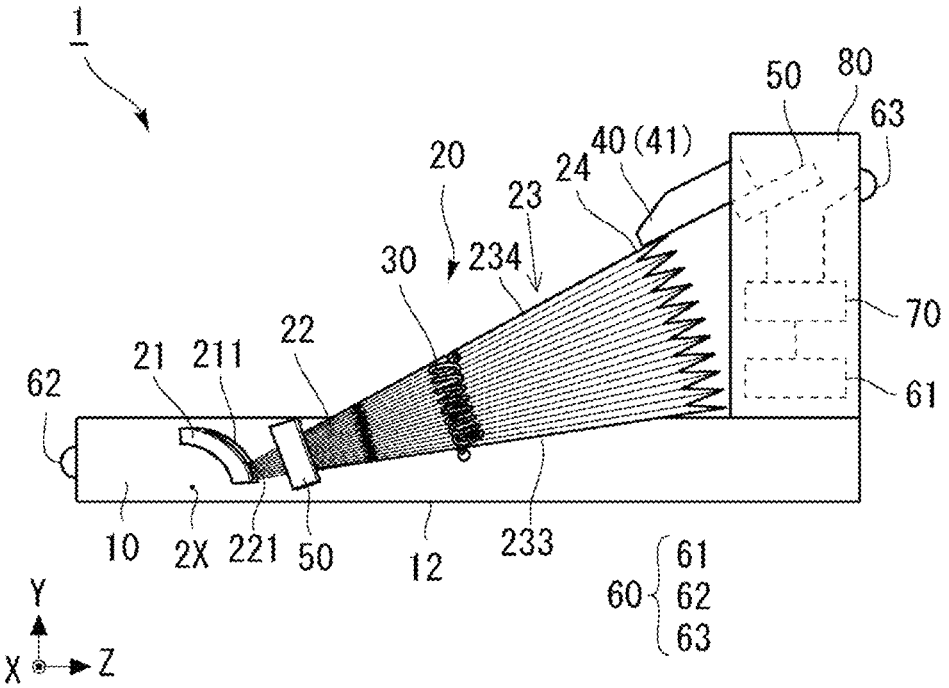
FIG. 1 is a side view of a protection device according to an embodiment of the present disclosure.
Figure 2:
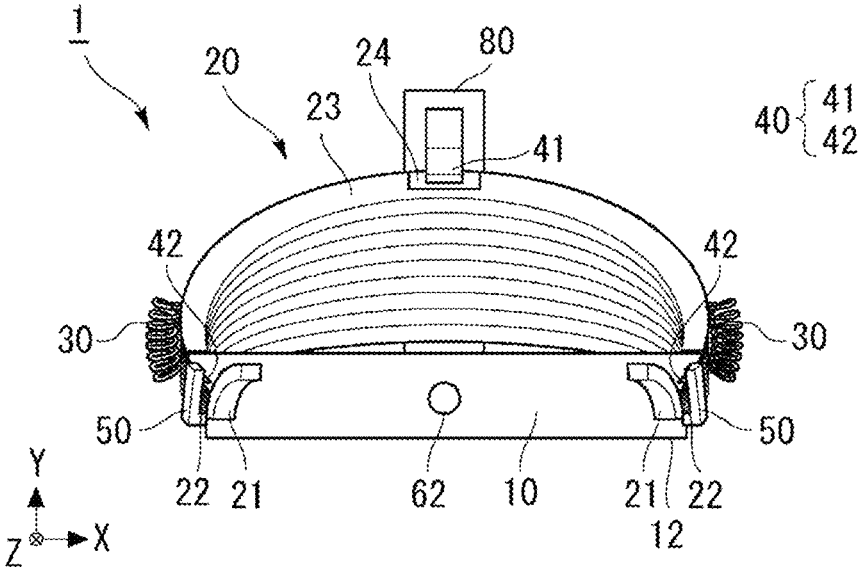
FIG. 2 is a front view of the protection device according to the embodiment.
Figure 3:
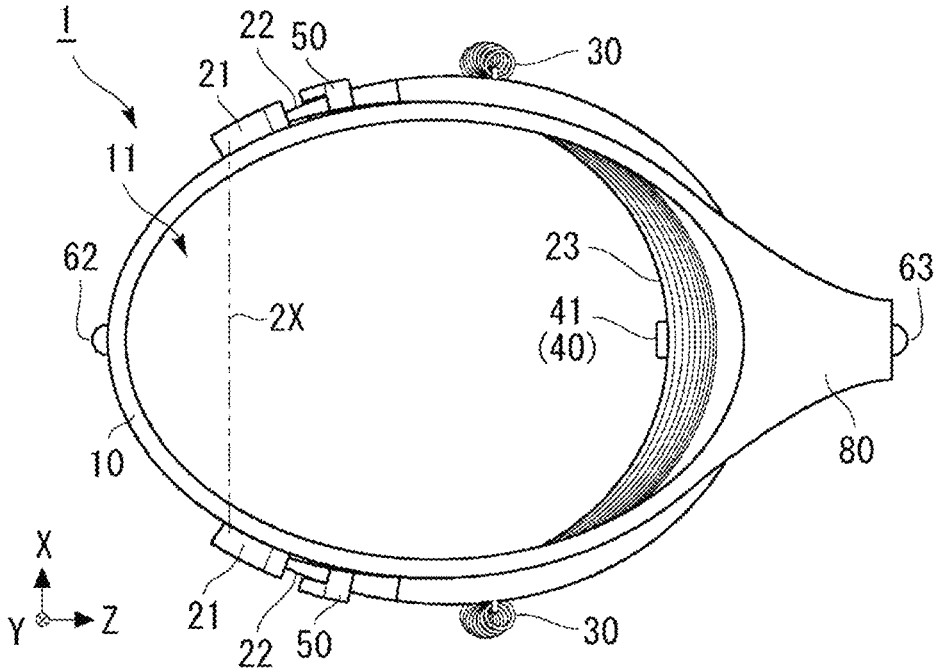
FIG. 3 is a bottom view of the protection device according to the embodiment.
Figure 4:
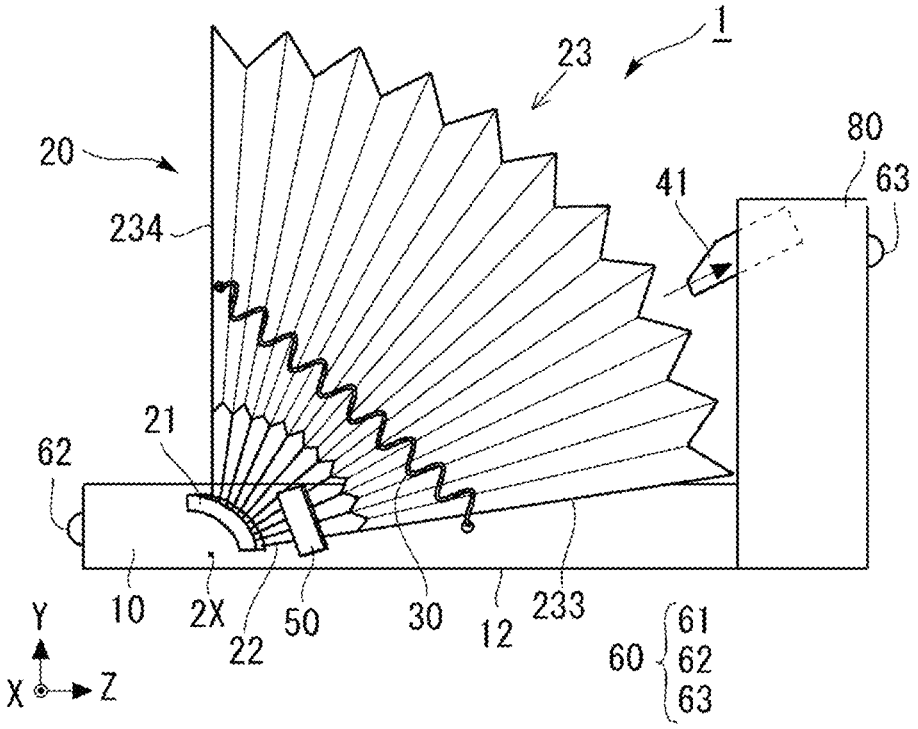
FIG. 4 is a side view of the protection device in a state after a protection unit is unfolded (unfolded orientation).
Figure 5:
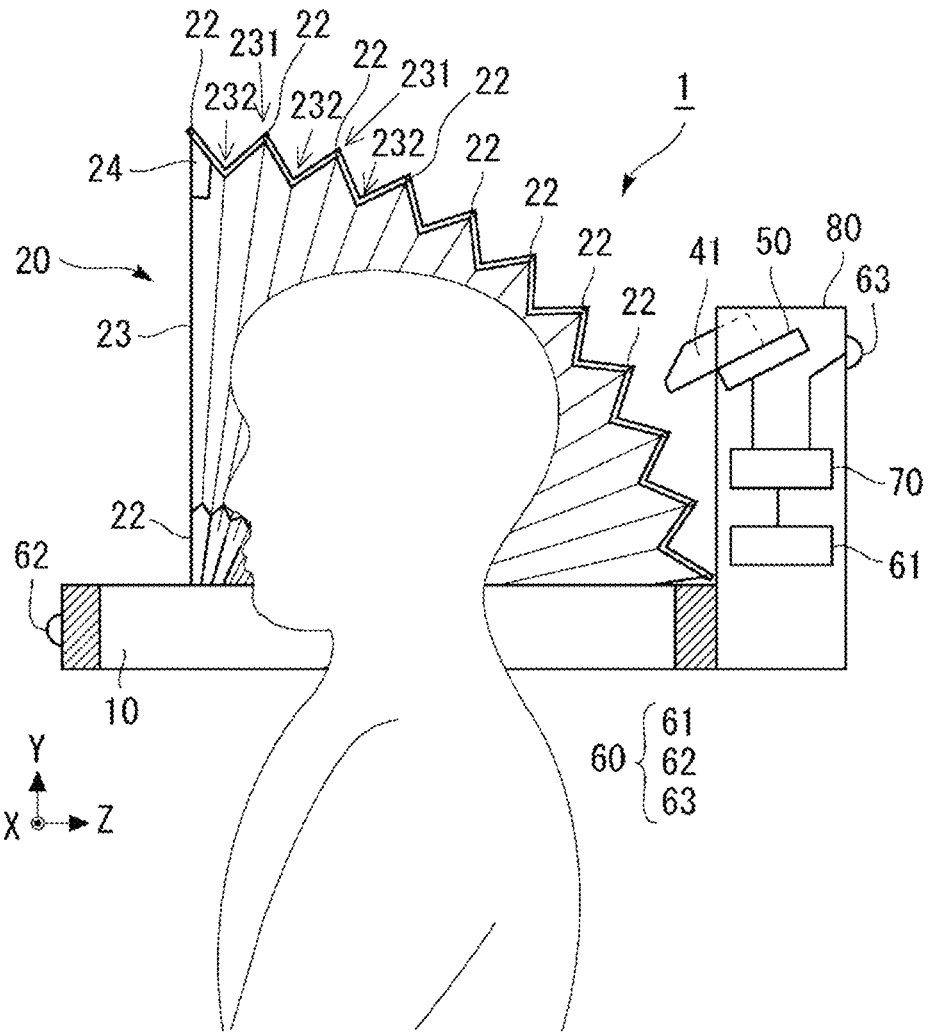
FIG. 5 is a vertical cross-sectional view of the protection device in the unfolded orientation.
Figure 6:
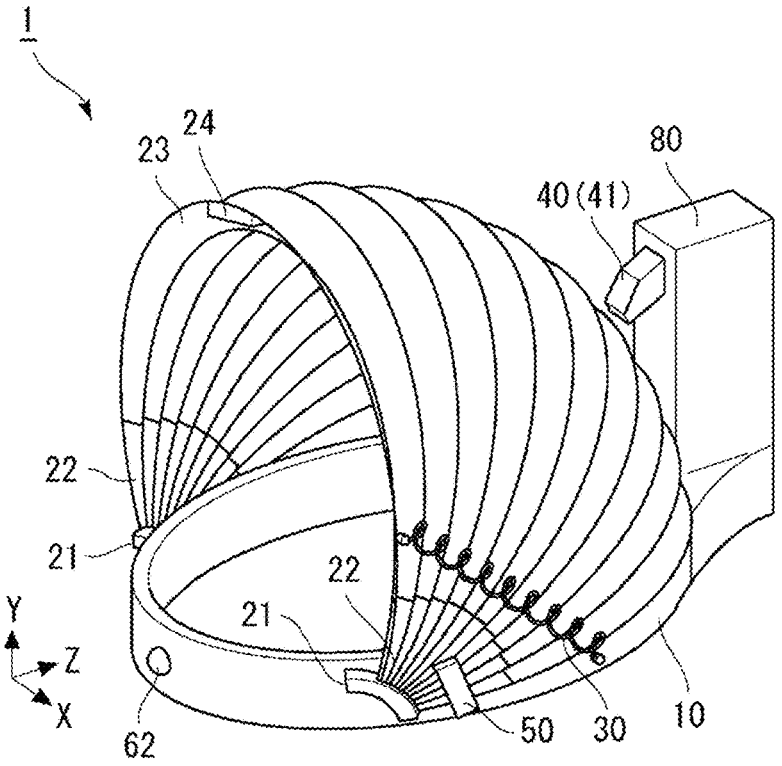
FIG. 6 is a perspective view of the protection device in the unfolded orientation.

FIG. 1 is a side view of a protection device 1, FIG. 2 is a front view of the protection device 1, and FIG. 3 is a bottom view of the protection device 1. The protection device 1 illustrated in FIG. 1 is worn on the body (human body) of a user and protects at least the head of the user. The protection device 1 includes a base portion 10, a protection unit 20, drive portions 30, a lock portion 40, trigger portions 50, a detection unit 60, a control unit 70, and a rear enclosure 80. The protection device 1 protects the head by unfolding the protection unit 20 around the head when the detection unit 60 detects reception of an impact, for example, a fall or an unavoidable collision of the user, or predictable occurrence of an impact on the body of the user (hereinafter, also referred to as an emergency). FIGS. 1 to 3 are diagrams illustrating a state before the protection unit 20 is unfolded (folded orientation). FIG. 4 is a side view of the protection device 1 in a state after the protection unit 20 is unfolded (unfolded orientation). FIG. 5 is a vertical cross-sectional view of the protection device 1 in the unfolded orientation. FIG. 6 is a perspective view of the protection device 1 in the unfolded orientation. In the present specification, the up-down direction is also referred to as a Y-axis direction, the left-right direction is also referred to as an X-axis direction, and the depth direction is also referred to as a Z-axis direction. However, in the present specification, the up-down direction and the X-axis, Y-axis, and Z-axis directions of the protection device 1 merely indicate relative positional relationships among the elements in the protection device 1 for convenience of description of the embodiments. For example, the orientation when the protection device 1 is used is not limited to the direction illustrated in the drawing. In addition, the size of the protection device 1 for the human body is not limited to that illustrated in the drawing. In the present example, a power supply unit that drives the control unit, the detection unit, the trigger portion, and the like is also included, but is omitted from the description.

The base portion 10 is a base body that is worn on the body of a user and holds the protection unit 20, the drive portions 30, the lock portion 40, the trigger portions 50, the detection unit 60, the control unit 70, and the rear enclosure 80 at predetermined positions with respect to the body of the user. The base portion 10 of the present embodiment is a ring-shaped member, and an inner space 11 of the ring is formed larger than the head of the user and smaller than the shoulder width of the user. Therefore, when the user passes the head through the inner space 11, a lower surface 12 of the base portion 10 is brought into contact with the shoulders of the user and stops, and the base portion 10 is worn while being disposed on the neck of the user. In other words, the protection device 1 is disposed above the shoulders of the user and substantially on the lower side of the head.

One end of the protection unit 20 is connected to the base portion 10, and the protection unit 20 can reversibly switch its orientation between a folded orientation in which the protection unit 20 is folded and an unfolded orientation in which the protection unit 20 is unfolded from the folded orientation and thus covers the head of the user, that is, to change the orientation. The protection unit 20 includes guide rails 21, ribs 22, a buffer material 23 having a buffering function, and a presser plate 24.

As illustrated in FIG. 2, the guide rails 21 are disposed on left and right side surfaces of the base portion 10, respectively. As illustrated in FIGS. 1 and 4, the guide rails 21 are formed in an arc shape about a virtual rotation axis 2X. The rotation axis 2X can be arbitrarily set in accordance with the shape of the protection unit 20, a portion of the user to be protected, or the like. For example, the rotation axis 2X may be a straight line at a predetermined position, which connects the left and right side surfaces of the base portion 10. In the present embodiment, the rotation axis 2X is a straight line in the horizontal direction (X-axis direction) orthogonal to the depth direction (Z-axis direction) of the base portion 10. Additionally, a groove 211 is provided on each of the arc-shaped outer side surfaces of the guide rails 21 along the longitudinal direction of the guide rails 21. Left and right end portions 221 of the ribs 22 are slidably attached to the grooves 211.

The ribs 22 are each a substantially linear member. The ribs 22 are bridged between the guide rails 21 disposed on the left and right side surfaces of the base portion 10, and are disposed curved in a protruded shape from one guide rail 21 to the other guide rail 21. The ribs 22 slide along the grooves 211 of the guide rails 21 at the time of unfolding of the buffer material 23 as described below; and thus the buffer material 23 is unfolded in a bowl shape. The ribs 22 are formed of, for example, a hard synthetic resin. No such limitation is intended, and the ribs 22 may be formed of another material such as metal as long as the rib 22 can ensure predetermined rigidity.

The buffer material 23 has a shape forming at least a portion of the bowl shape and thus covering the head of the user, and can reversibly switch its orientation between a folded orientation and an unfolded orientation by an expansion and contraction structure. Note that the expansion and contraction structure is not particularly limited, but may be, for example, a honeycomb structure or a bellows structure. The buffer material 23 of the present example has a bellows structure. As illustrated in FIG. 5, the bellows structure has a shape in which a plurality of crest portions 231 protruding toward the outside of the protection unit 20 and trough portions 232 formed between the crest portions 231 are alternately disposed in the vertical cross-section (YZ cross-section). The crest portions 231 and the trough portions 232 are formed in a continuous shape from the front side to the back side with respect to the page of FIG. 5, that is, in a corrugated shape. In addition, the buffer material 23 is provided with ribs 22 along ridge lines of the respective crest portions 231, and is connected to the guide rails 21 via the ribs 22.

One end of the buffer material 23 is a fixed end 233 fixed to the base portion 10, and the other end is a free end 234 not fixed to the base portion 10. When the free end 234 is moved from the unfolded orientation illustrated in FIG. 5 and comes close to the fixed end 233, the buffer material 23 is folded and thus the crest portions 231 come close to each other and the trough portions 232 come close to each other. Consequently, the bellows structure is contracted as illustrated in FIG. 1. On the other hand, when the free end 234 of the buffer material 23 in the folded orientation illustrated in FIG. 1 is moved separated from the fixed end 233, the buffer material 23 is unfolded and the crest portions 231 separate from each other and the trough portions 232 separate from each other, and thus the bellows structure is extended and brought into the unfolded orientation as illustrated in FIG. 5.

The buffer material 23 is made of a material or a structure that absorbs impact. For example, the buffer material 23 may be formed of an elastic material such as silicone resin, natural rubber, or soft plastic. Also, the buffer material 23 may be formed as a material to structurally absorb impact, for example, a foamed material such as foamed polystyrene or foamed polyurethane, a sponge of resin, a bubble wrap in which gas is sealed in a sheet, or a gel sheet in which gel is sealed in a sheet.

The presser plate 24 is a flat plate attached to the free end 234 of the buffer material 23. The presser plate 24 is attached such that it is located at an upper end of the buffer material 23 when the protection unit 20 is brought into the folded orientation, and is brought into engagement with the lock portion 40 to press the buffer material 23 and thus the buffer material 23 is not unfolded. The presser plate 24 is formed of, for example, a hard synthetic resin or metal and has high rigidity. As long as the presser plate 24 is in contact with the lock portion 40, the arrangement position and the size of the presser plate 24 are not specified. However, in a case where the presser plate 24 is attached in a wide range along the peripheral edge of the free end 234, even when a range of the presser plate 24 to be brought into contact with the lock portion 40 is narrow; the pressing force by the lock portion 40 can be transmitted to a wide range of the buffer material 23, and thus the unfolding of the buffer material 23 can be suppressed.

The drive portions 30 are a drive mechanism that unfolds the protection unit 20 by driving the free end 234 of the protection unit 20 in the folded orientation to separate the free end 234 from the fixed end 233. The drive portions 30 of the present embodiment are each an elastic member (for example, a spring) having one end connected to the free end 234 of the protection unit 20 and the other end connected to the fixed end 233. One end of the elastic member may be attached near the free end 234 of the protection unit 20. The drive portions 30 are attached to bias the free end 234 of the protection unit 20 in a direction in which the free end 234 is unfolded by the elastic force of the drive portions 30. When the user changes the protection unit 20 from the unfolded orientation to the folded orientation, the drive portions 30 are compressed against the elastic force and are locked in this state by the lock portion 40. When the lock is released, the drive portions 30 drive the free end 234 of the protection unit 20 by its elastic force to unfold the protection unit 20. Note that the drive portions 30 may each be an elastic member other than a spring and may each be a member such as an electric actuator or a magnetic force, which drives the protection unit 20 with force other than elastic force. The drive portions 30 are not essential components. For example, when the buffer material 23 of the protection unit 20 has elastic force and the protection unit 20 can be unfolded by the elastic force of the buffer material 23, the drive portions 30 may be omitted. In other words, the buffer material 23 of the protection unit 20 may also serve as a drive portion, and the protection unit 20 may be unfolded by the elastic force of the buffer material 23.

The lock portion 40 is a member that locks the protection unit 20 in the folded orientation. The lock portion 40 includes a first lock portion 41 that is to be engaged with the presser plate 24 of the protection unit 20 to suppress the unfolding of the protection unit 20, and second lock portions 42 that are to be engaged with the ribs 22 of the protection unit 20 on the left and right side surfaces of the protection device 1 to suppress the unfolding of the protection unit 20. As described above, the protection unit 20 is locked at one position by the first lock portion 41 and at two positions on the left and right by the second lock portions 42 in the present embodiment, but no such limitation is intended. For example, the protection unit 20 may be locked at only one position of the first lock portion 41 or may be locked by the lock portions 40 disposed at four or more positions.

The trigger portions 50 release the protection unit 20 locked by the lock portion 40 and thereby unfolding the protection unit 20. For example, the trigger portions 50 are electric actuators, and perform switching between a locked state and a released state by moving the lock portion 40 forward and backward.

The detection unit 60 is a unit that detects a state of the user or a state around the user, and includes, for example, a sensing unit such as an acceleration sensor, a gyro sensor (angular velocity sensor), a positioning device, a camera, a radar, light detection and ranging, laser imaging detection and ranging (LIDAR), a three-dimensional scanner, a temperature sensor, a humidity sensor, a contact sensor, or an infrared sensor. The detection unit 60 may detect a state change of the user such as a case where the user falls down or a case where the user is hit by another object, or may predict that the user will receive an impact. In addition, the detection unit 60 may detect a state change of an object existing around the user, such as an object approaching the user and likely to collide with the user or an object having collided with the user. Examples of the positioning device may include a satellite positioning system such as a global positioning system (GPS). The radar and the LIDAR obtain a distance to an object existing around the protection device 1 (user) and a moving speed of the object.

In the present embodiment, an acceleration sensor 61 that senses the acceleration of the protection device 1, that is, the acceleration of the user wearing the protection device 1 is provided as a first detection unit 60. The acceleration sensor 61 senses a rate of change in the speed on a predetermined axis (for example, three axes in the XYZ directions) and a direction thereof as the acceleration of each axis. The acceleration sensor 61 may be a so-called 6-axis sensor also serving as a sensor that senses angular speeds on these axes. A camera 62 is provided as a second detection unit 60 at a front side portion of the base portion 10, and captures an image in front of the user and inputs the captured image as information indicating a state around the user into the control unit 70. Note that the camera 62 may be a stereo camera that can capture an image of the same subject (object) with a pair of imaging units disposed at a predetermined distance (baseline length) from each other and detect, for example, a distance to the subject from a parallax therebetween. In addition a camera 63 is provided as a third detection unit 60 at a rear side portion of the rear enclosure 80, and captures an image of the rear side of the user and outputs the captured image as information indicating a state around of the user to the control unit 70. The camera 63 may be a stereo camera like the camera 62. The cameras 62, 63 disposed at the front and the rear as just described each capture an image at an angle of view of, for example, 190 degrees or more, thereby capturing an image of the entire circumference around the user. Although not illustrated in FIGS. 1 to 6, a detection unit 60 other than the acceleration sensor 61 and the cameras 62, 63 may be provided.

The rear enclosure 80 is connected to a rear portion of the base portion 10 and internally includes the lock portion 40, the trigger portions 50, the detection unit 61, and the control unit 70. The rear enclosure 80 extends from the base portion 10 in an up-down direction. The rear enclosure 80 holds the lock portion 40 and the trigger portions 50 at predetermined positions with respect to the protection unit 20, specifically, on the level at which the lock portion 40 can be advanced to above the protection unit 20 in the folded orientation to suppress the unfolding of (lock) the protection unit 20, and includes the trigger portions 50 and thus the lock can be released by retraction of the lock portion 40 from above the protection unit 20 when the protection device 1 is activated.

Figure 7:
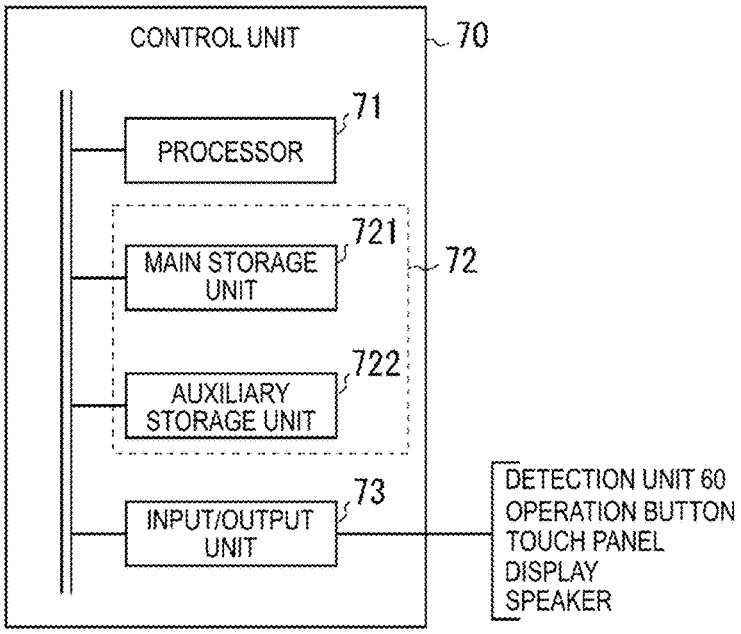
FIG. 7 is a diagram illustrating the configuration of a control unit.

The control unit 70 acquires the detection result by the detection unit 60, and controls the trigger portions 50 to release the lock by the lock portion 40 when the detection result satisfies a predetermined condition. FIG. 7 is a diagram illustrating the configuration of the control unit 70. The control unit 70 includes a processor 71, a storage unit 72, and an input/output unit 73. The processor 71 integrally executes a variety of arithmetic processing in the control unit 70. The processor 71 is an arithmetic processing unit such as a central processing unit (CPU), a digital signal processor (DSP), or a field-programmable gate array (FPGA).

The storage unit 72 includes, for example, a main storage unit 721 and an auxiliary storage unit 722. The main storage unit 721 includes a main storage unit such as a random access memory (RAM) or a read only memory (ROM), and, for example, information to be subjected to arithmetic processing by the processor 71 is expanded in the main storage unit 721. Note that the main storage unit 721 may be formed integrally with the processor 71.

The auxiliary storage unit 722 includes a storage medium, for example, a volatile memory such as a RAM, a nonvolatile memory such as a ROM, an erasable programmable ROM (EPROM), a hard disk drive (HDD), or a removable medium. Note that the removable medium is, for example, a recording medium that can be attached from the outside and is computer-readable, such as a universal serial bus (USB) memory or a memory card.

The auxiliary storage unit 722 can store an operating system (OS), various programs, various tables, various databases, user data, and the like for performing the operation of the protection device 1.

The input/output unit 73 is, for example, an interface that inputs information (detection results or the like) from the detection unit 60 and outputs information (a control signal or the like) to the detection unit 60 or another device. Further, the input/output unit 73 may be a communication module that performs input (reception) of information from another device and output (transmission) of information to another device. Furthermore, the input/output unit 73 may be a user interface that performs input of operation information by the user with an operation button or a touch screen and output (display, sound output, or the like) to the user with a display or a speaker.

Protection Operation

Figure 8:
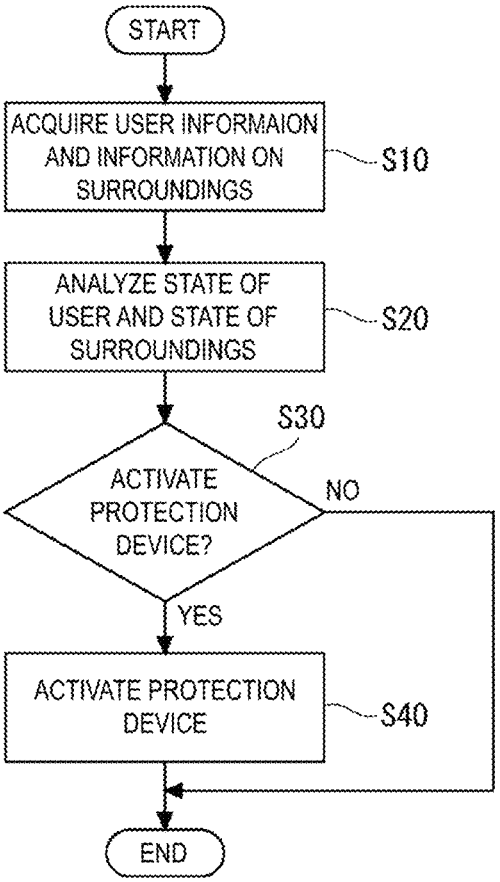
FIG. 8 is a chart showing the procedure to be executed by the control unit of the protection device.

FIG. 8 is a chart showing the procedure to be executed by the control unit 70 of the protection device 1. The protection device 1 repeatedly executes the processing of FIG. 8 during a period in which a power supply is ON or when an activation instruction is received.

In step S10, the control unit 70 acquires the state of the user and the state of the surroundings from the detection unit 60. For example, the control unit 70 acquires the acceleration of the user from the acceleration sensor 61 and detects the captured image of the surroundings from the cameras 62, 63.

In step S20, the control unit 70 analyzes the state of the user and the state around the user based on the detection result of the detection unit 60 acquired in step S10. For example, the control unit 70 obtains, based on the acceleration on each axis sensed by the acceleration sensor 61, information indicating the state of the user, such as a moving direction, a moving speed, a rate of change in the acceleration (jerk) per unit time, and an inclination with respect to the direction of gravitational force of the user. Further, the control unit 70 extracts an object existing around the user by performing image processing on the image captured by the cameras 62, 63, and obtains a position, a moving direction, a moving speed, and the like of the object as information on the surroundings. Furthermore, the control unit 70 may detect a motion of the user, such as walking, sitting, running, riding on a bicycle, or stopping, based on the image captured by the cameras 62, 63. Note that a known technique can be used as a method of obtaining the position, the speed, the moving direction, and the like of the object from the captured image, and thus the detailed description will be omitted. Additionally, the position, the speed, and the moving direction of the object are not necessarily acquired by the cameras 62, 63 and may be acquired by a radar, a LIDAR, a three-dimensional scanner, or a combination thereof.

In step S30, the control unit 70 determines whether to activate the protection device 1 depending on whether the information indicating the state of the user and the state of the surroundings obtained in step S20 satisfies a predetermined condition. For example, when the user collides with something or is hit by a vehicle or the like and thus receives an impact, the impact is detected as a sudden change in the acceleration. Therefore, when the jerk obtained in step S20 exceeds a predetermined threshold value, the control unit 70) determines that the user has received an impact and the protection device 1 is to be activated (affirmative determination). Further, when the user falls down, the head (protection device 1) of the user falls down with an acceleration close to that of free fall. Therefore, when it is determined in step S20 that the user has moved downward with the acceleration exceeding the predetermined threshold value, the control unit 70 makes an affirmative determination that the user has fallen down, that is, the head of the user is likely to receive an impact. Furthermore, when the position of the user after a predetermined time coincides with the position of an object around the user, that is, when the object collides with the user, the control unit 70 makes an affirmative determination based on the position, the moving direction, the moving speed, and the like of the object obtained in step S20. Note that the conditions and threshold values may be set by operation of the user. Alternatively, when a vehicle or the like is moving toward the user and a collision can be predicted to be unavoidable in consideration of a speed, an acceleration, a traveling direction, and the like of the vehicle, an affirmative determination may be made. Here, the control unit 70 may determine based on the detection result of the detection unit 60 such as a contact sensor or an infrared sensor whether the protection device 1 is worn by the user, and the protection device 1 need not be activated regardless of the presence or absence of an impact in a case where the protection device 1 is not worn. In addition, the control unit 70 may determine based on the detection result of the detection unit 60 such as a positioning device or an acceleration sensor whether the protection device 1 (user) is moving, and the protection device 1 need not be activated in a case where the protection device 1 is not moving.

When an affirmative determination is made in step S30, the control unit 70 proceeds to step S40 and controls the trigger portions 50 to retract the lock portion 40 and release the lock. As a result, the drive portion 30 allows the free end 234 of the protection unit 20 to separate from the fixed end 233, and each rib of the protection unit 20 moves along the guide rails 21, and thus at least the free end 234 rotates about the rotation axis 2X as a rotation center to unfold the protection unit 20, that is, to activate the protection device 1. Then, when the activation is completed and the protection device 1 is reset, the user operates the free end 234 of the protection unit 20 to bring the free end 234 close to the fixed end 233, and thus the protection unit 20 is rotated in the opposite direction to that at the time of activation and then is folded. In other words, by the drive control and the user operation, the protection unit 20 is reversibly changed between the folded orientation before activation and the unfolded orientation after activation.

Note that when the information indicating the state of the user and the state of the surroundings does not satisfy the predetermined condition and a negative determination is made in step S30, the processing of FIG. 8 ends.

Operational Advantages

As described above, when the user falls down, when the user is likely to be hit by a vehicle, or when it is predicted that the user will receive an impact, the protection device 1 unfolds the protection unit 20 and thus it covers the head of the user. Consequently, the protection device 1 can absorb the impact on the head with the protection unit 20 and protect the head of the user.

Further, in the protection device 1 of the present embodiment, since the protection unit 20 has a bellows structure, the folded orientation and the unfolded orientation can be reversibly switched. Therefore, unlike a known airbag type device, the protection unit 20 can be returned to the folded orientation and used repeatedly even after the protection device 1 is activated. Note that in FIG. 4, the buffer material 23 may be unfolded to such an extent that the buffer material 23 covers the face of the user.

First Modification

Figure 9:
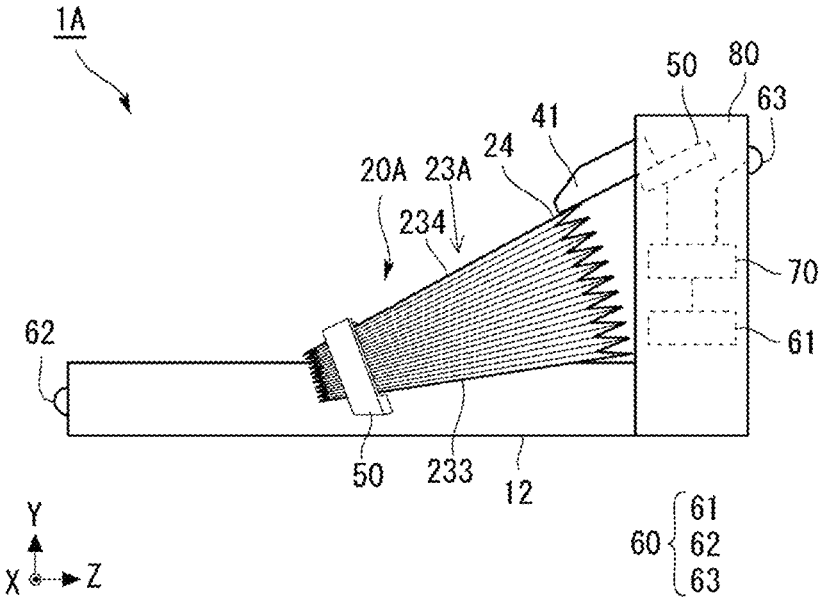
FIG. 9 is a side view of a protection device according to a first modification, illustrating a state in which a protection unit is in a folded orientation.
Figure 10:
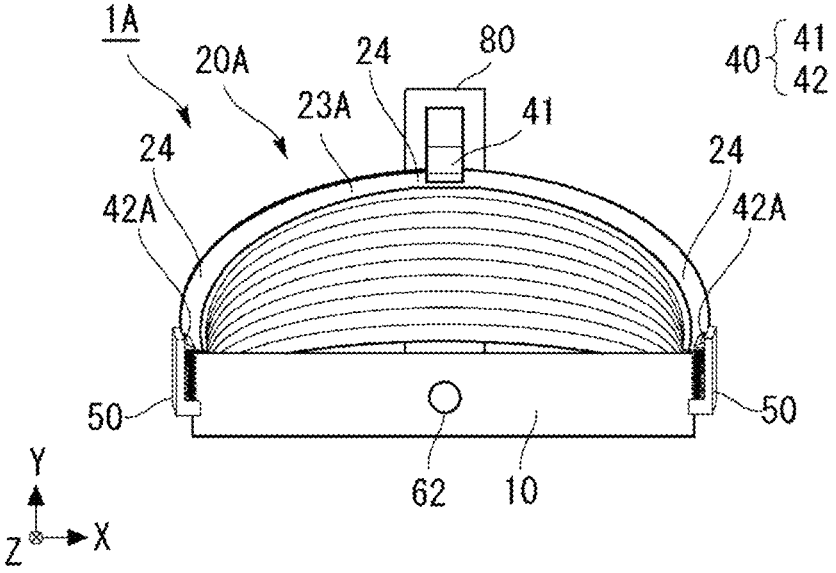
FIG. 10 is a front view of the protection device according to the first modification, illustrating a state in which the protection unit is in the folded orientation.
Figure 11:
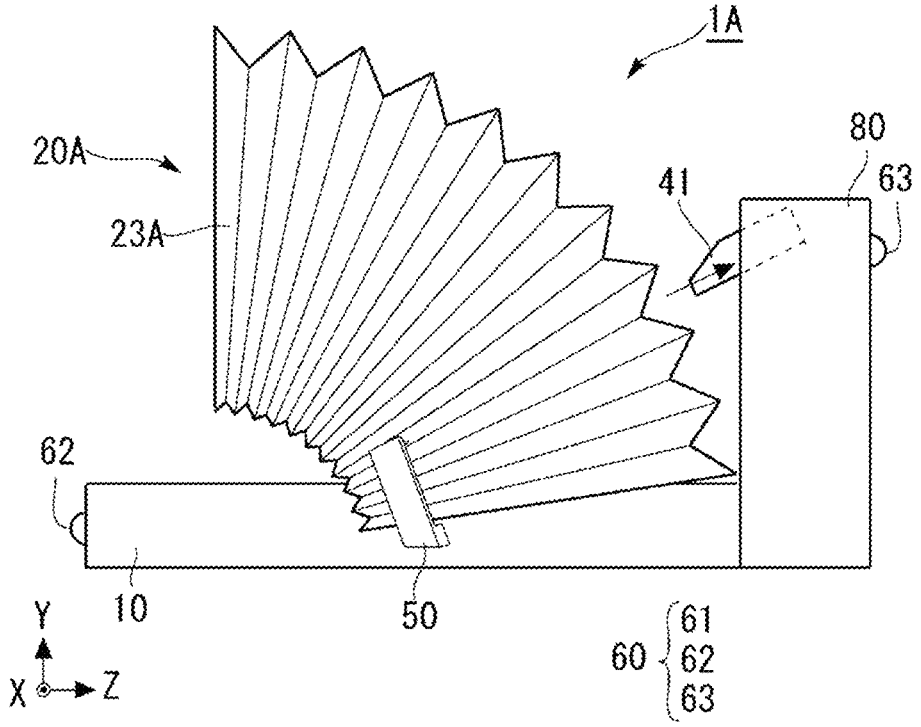
FIG. 11 is a side view of the protection device according to the first modification, illustrating a state in which the protection unit is in an unfolded orientation.

FIG. 9 is a side view of a protection device 1A according to a first modification, illustrating a state in which a protection unit 20A is in a folded orientation. FIG. 10 is a front view of the protection device 1A according to the first modification, illustrating a state in which the protection unit 20A is in the folded orientation. FIG. 11 is a side view of the protection device 1A according to the first modification, illustrating a state in which the protection unit 20A is in an unfolded orientation.

The protection device 1A of the present modification is different from the first embodiment described above in that the elastic force of the protection unit 20A is used as a drive source for unfolding and the guide rails 21, the ribs 22, and the drive portions 30 are omitted, and the rest of the configuration is the same. Accordingly, the same elements as those of the first embodiment are denoted by the same reference numerals or the like and the description thereof will not be repeated.

The protection unit 20A includes a buffer material 23A and a presser plate 24A. The presser plate 24A is disposed over the entire width in the left-right direction of the buffer material 23A. The lock portion 40 includes the first lock portion 41 that is engaged with a center portion of the presser plate 24A of the protection unit 20A to suppress the unfolding of the protection unit 20A, and second lock portions 42A that are engaged with left and right end portions of the presser plate 24A to suppress the unfolding of the protection unit 20A. The second lock portions 42A are held by second trigger portions 50 on left and right side portions of the base portion 10 and are movable forward and backward.

The buffer material 23A having a bellows structure is compressed against its elastic force, and the protection unit 20A is brought into the folded orientation and locked by the lock portion 40, resulting in the state illustrated in FIGS. 9 and 10. Note that the configuration in which the control unit 70 controls the trigger portion 50 in accordance with the state of the user and the state of the surroundings to release the lock portion 40 is the same as that in the first embodiment described above. When the lock is released, the protection unit 20A is unfolded by the elastic force of the buffer material 23A and brought into the state illustrated in FIG. 11.

As described above, the protection device 1A according to the present modification uses the elastic force of the buffer material 23A as a drive source, and unfolds the protection unit 20A such that it covers the head of the user at the time of activation. Thus, the protection device 1A can absorb an impact with the protection unit 20A and suppress damage to the head.

In addition, the protection device 1A of the present modification uses the elastic force of the buffer material 23A as a drive source, and thus the drive portions 30, the guide rails, and the ribs can be omitted. As a result, the configuration can be simplified.

Second Modification

Figure 12:
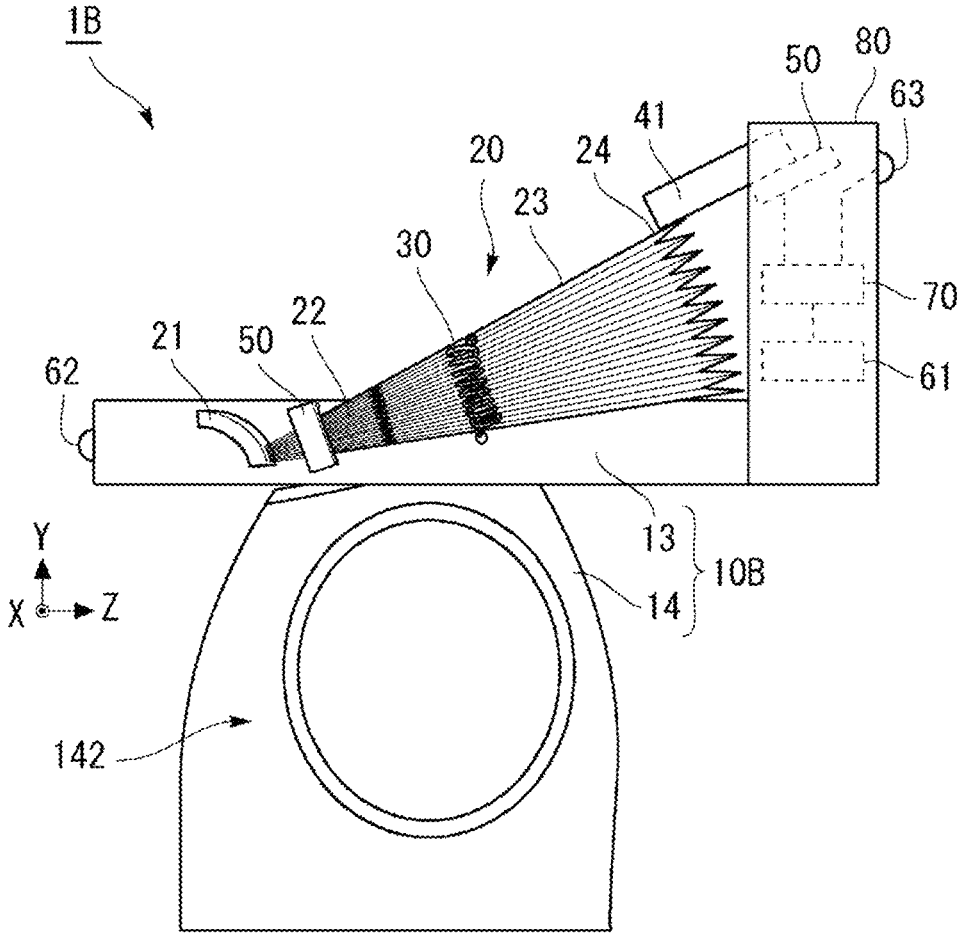
FIG. 12 is a side view of a protection device according to a second modification, illustrating a state in which the protection unit is in the folded orientation.
Figure 13:
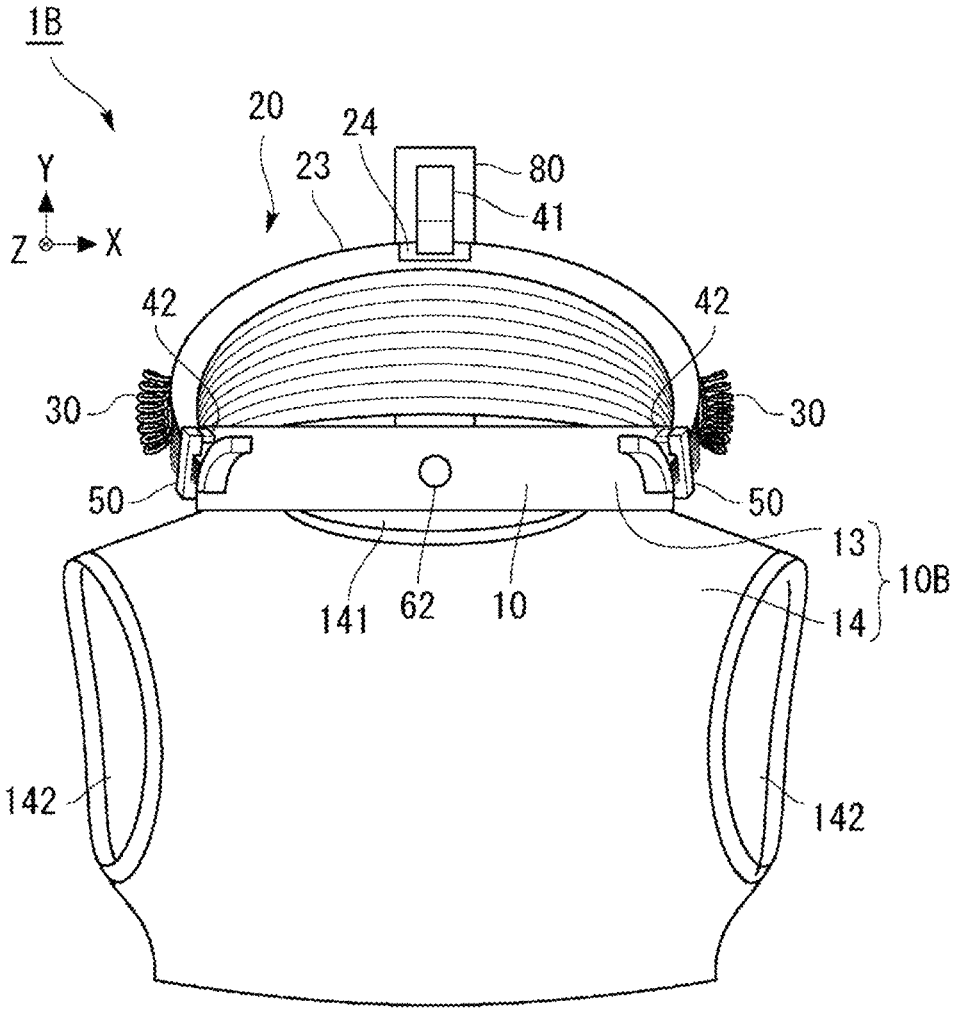
FIG. 13 is a front view of the protection device according to the second modification, illustrating a state in which the protection unit is in the folded orientation.
Figure 14:
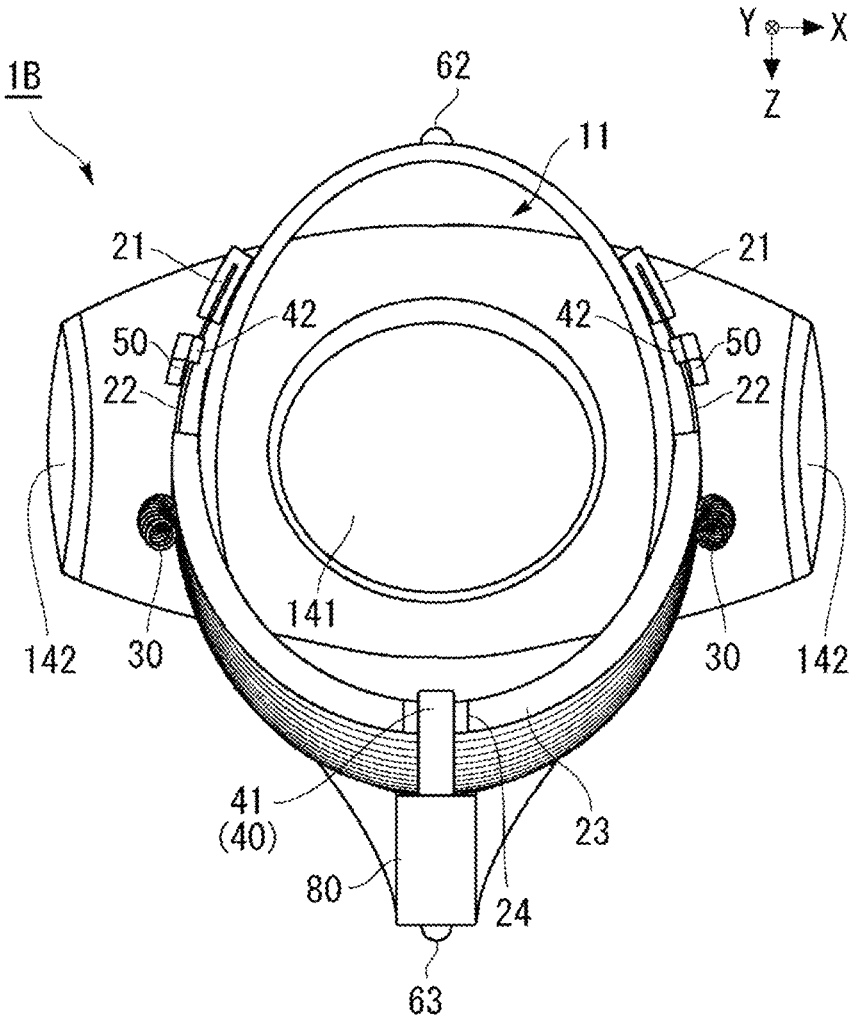
FIG. 14 is a plan view of the protection device according to the second modification, illustrating a state in which the protection unit is in the folded orientation.
Figure 15:
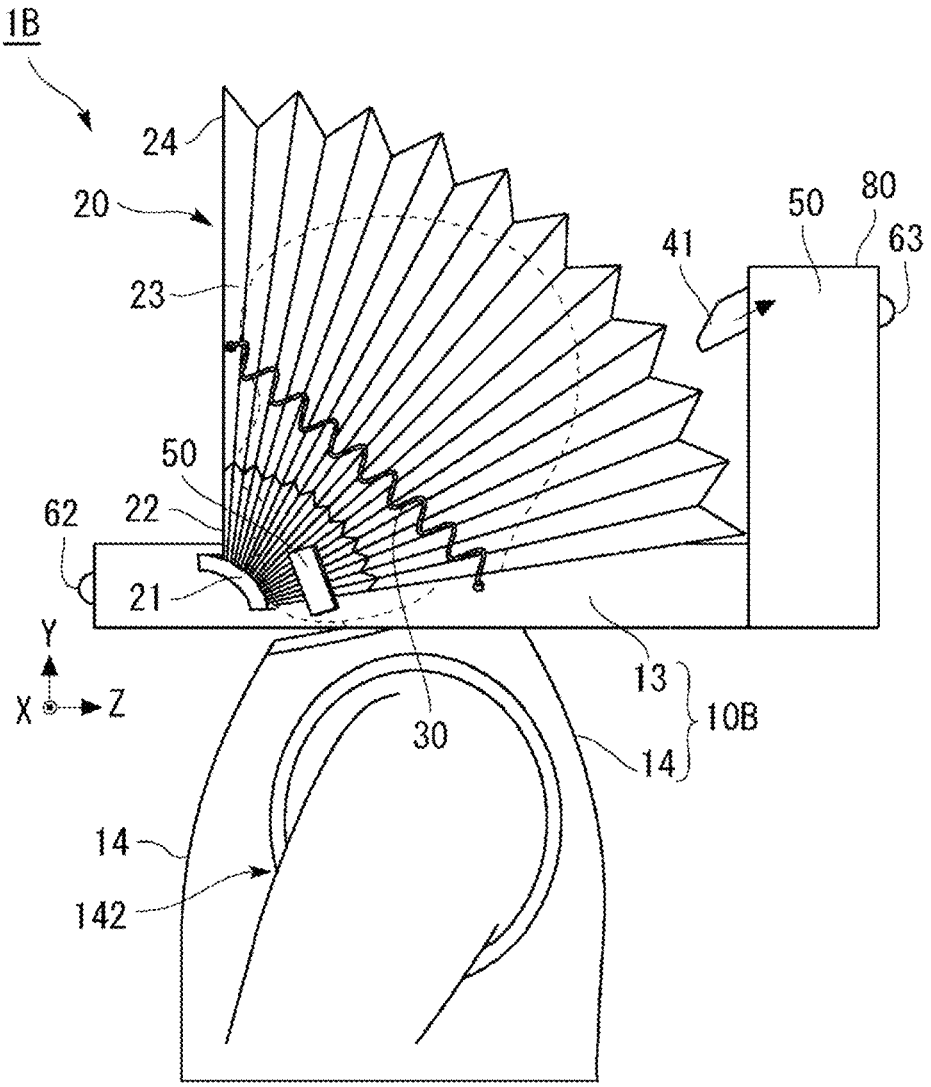
FIG. 15 is a side view of the protection device according to the second modification, illustrating a state in which a user wears the protection device and the protection unit is unfolded.

FIG. 12 is a side view of a protection device 1B according to a second modification, illustrating a state in which the protection unit 20 is in the folded orientation. FIG. 13 is a front view of the protection device 1B according to the second modification, illustrating a state in which the protection unit 20 is in the folded orientation. FIG. 14 is a plan view of the protection device 1B according to the second modification, illustrating a state in which the protection unit 20 is in the folded orientation. FIG. 15 is a side view of the protection device 1B according to the second modification, illustrating a state in which the user wears the protection device 1B and the protection unit 20 is unfolded.

The protection device 1B of the present modification is different from the first modification described above in that a base portion 10B is a jacket type, and the rest of the configuration is the same. Accordingly, the same elements as those of the first modification are denoted by the same reference numerals or the like and the description thereof will not be repeated.

As illustrated in FIG. 13, the base portion 10B includes a neck enclosure 13 that has an elliptical ring shape and can be worn on the neck of the user in the same way as the base portion 10 in the aforementioned embodiment, and a jacket portion 14 connected to a lower portion of the neck enclosure 13. The jacket portion 14 is formed in a substantially bag shape by a flexible sheet such as cloth or synthetic resin, and is provided with a first hole portion 141 in an upper portion thereof and second hole portions 142 in left and right side portions thereof. The user passes the head through the first hole portion 141 of the jacket portion 14 and passes the left and right arms through the second hole portions 142, and thus the jacket portion 14 is worn on the chest of the user. The jacket portion 14 is one form of a fixing portion that fixes the base portion 10B to the human body.

The rear enclosure 80 is connected to a rear portion of the neck enclosure 13, and the second trigger portions 50 are disposed on left and right side portions of the neck enclosure 13. Note that the configuration in which the trigger portion (first trigger portion) 50 in the rear enclosure 80 and the second trigger portions 50 on the left and right side portions cause the lock portion 40 to advance to above the protection unit 20 and lock the protection unit 20, and the configuration in which the control unit 70 controls the trigger portion 50 in accordance with the state of the user and the state of the surroundings to release the lock portion 40 are the same as those in the aforementioned modification.

As described above, the arms of the user are passed through the jacket portion 14 of the base portion 10B and whereby the protection device 1B according to the present modification is worn. Accordingly, even when the user receives a strong impact, the protection device 1B is prevented from being detached from the user, and reliability is improved. Note that the neck enclosure 13 and the jacket portion 14 may be detachable from each other, and the neck enclosure 13 and the jacket portion 14 may be connected to each other when the user wears the protection device 1B. In addition, the control unit 70, the power supply unit, the detection unit 60, and the like may be shifted to the jacket portion 14, and the device may operate only after the neck enclosure 13 and the jacket portion 14 are connected to each other (including a device that warns of the state to the user).

Third Modification

Figure 16:
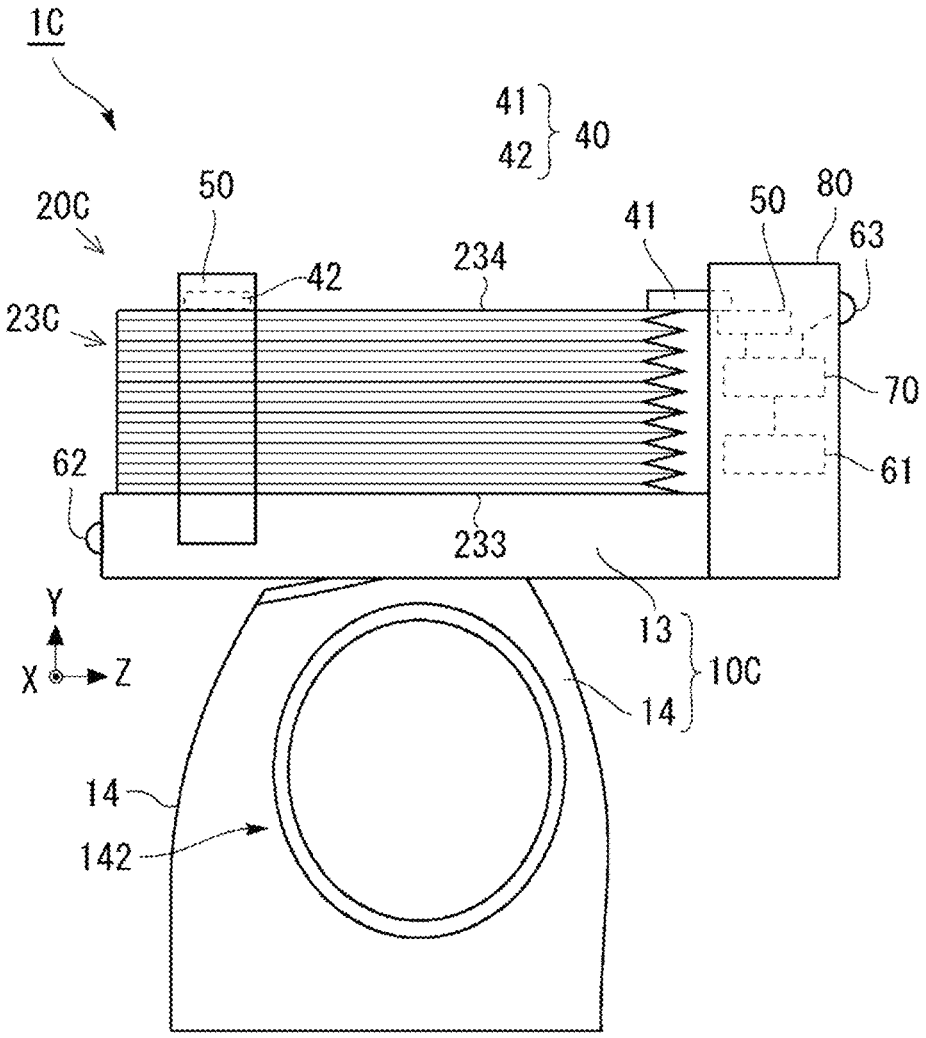
FIG. 16 is a side view of a protection device according to a third modification, illustrating a state in which a protection unit is in a folded orientation.
Figure 17:
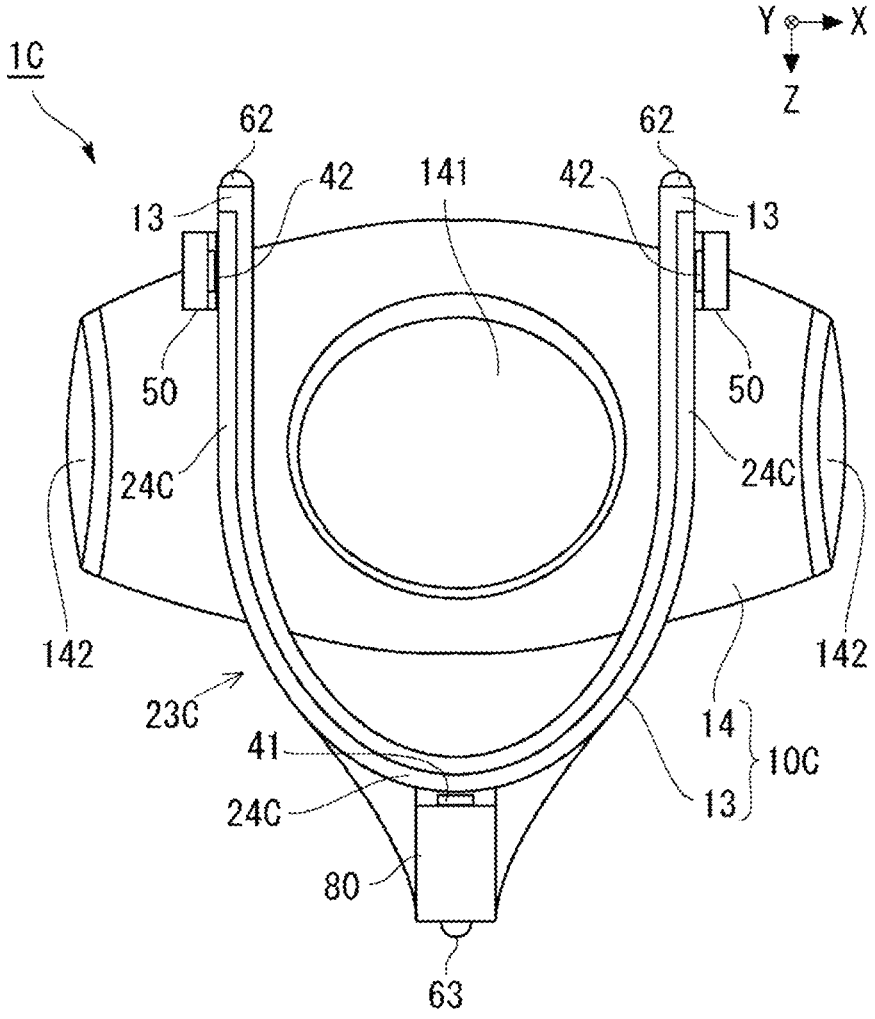
FIG. 17 is a plan view of the protection device according to the third modification, illustrating a state in which the protection unit is in an unfolded orientation.
Figure 18:
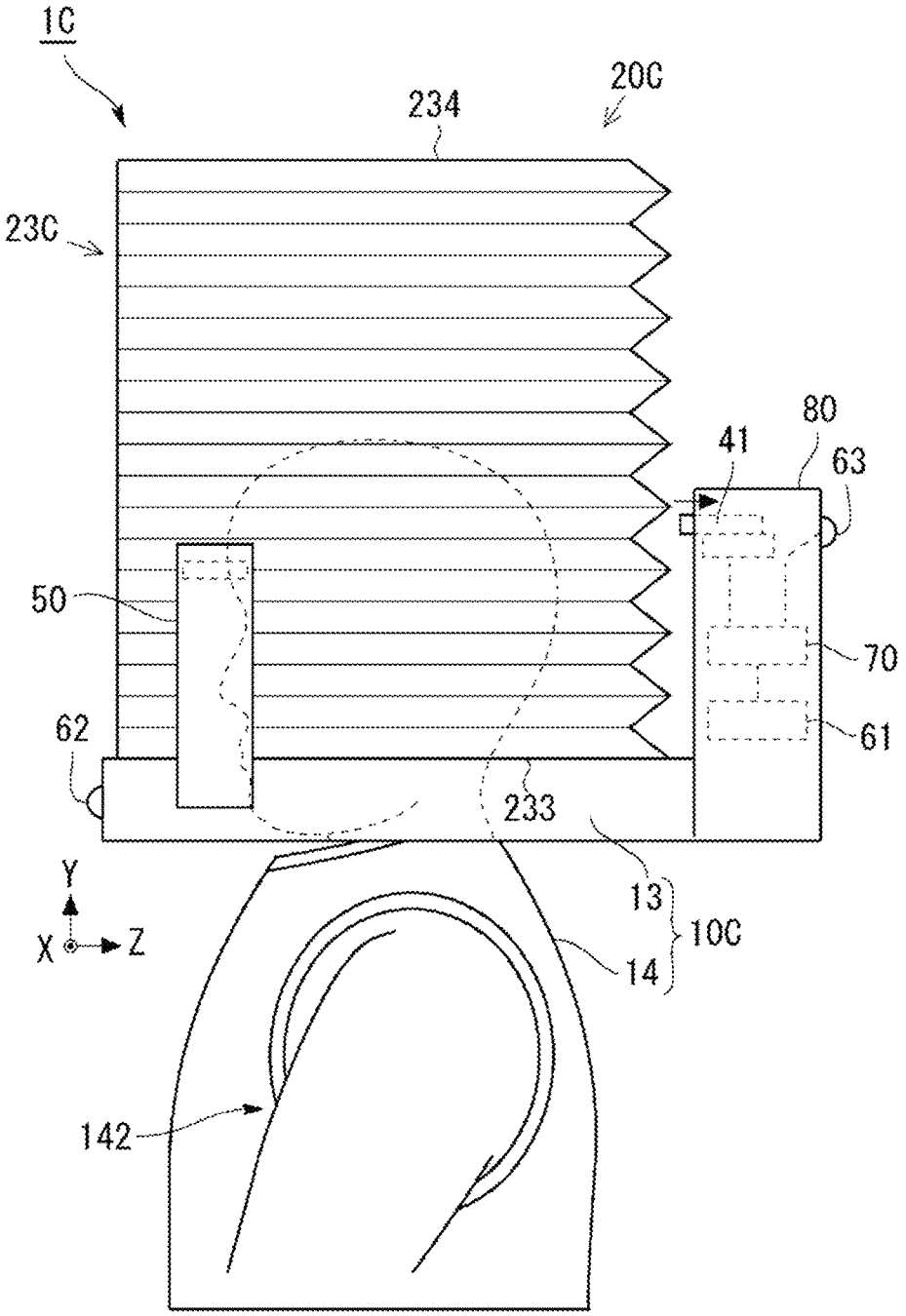
FIG. 18 is a side view of the protection device according to the third modification, illustrating a state in which a user wears the protection device and the protection unit is unfolded.

FIG. 16 is a side view of a protection device 1C according to a third modification, illustrating a state in which a protection unit 20C is in a folded orientation. FIG. 17 is a plan view of the protection device 1C according to the third modification, illustrating a state in which the protection unit 20C is in an unfolded orientation. FIG. 18 is a side view of the protection device 1C according to the third modification, illustrating a state in which the user wears the protection device 1C and the protection unit 20C is unfolded.

The protection device 1C according to the present modification is different from the third modification described above in that a buffer material 23C of the protection unit 20C is not curved forward but is unfolded upward, and the rest of the configuration is the same. Accordingly, the same elements as those of the third modification are denoted by the same reference numerals or the like and the description thereof will not be repeated.

As illustrated in FIG. 17, the neck enclosure 13 is disposed surrounding the head of the user in a U-shape in a plan view. The protection unit 20C includes the buffer material 23C and a presser plate 24C. The buffer material 23C is disposed in a U-shape in a plan view in the same way as the neck enclosure 13. The presser plate 24C is disposed in a U-shape not only in the vicinity of the center of the free end 234 of the buffer material 23C but also over the entire width in the left-right direction.

The buffer material 23C having a bellows structure is compressed against its elastic force and the protection unit 20C is locked in the folded orientation by the lock portion 40 (41, 42), resulting in the state illustrated in FIG. 16. Note that the configuration in which the control unit 70 controls the trigger portion 50 in accordance with the state of the user and the state of the surroundings to release the lock portion 40 is the same as that in the second modification described above. When the trigger portion 50 releases the lock by the lock portion 40, the protection unit 20C is unfolded upward by the elastic force of the buffer material 23C to form a gutter shape as illustrated in FIGS. 17 and 18.

As described above, the protection device 1C according to the present modification uses the elastic force of the buffer material 23C as a drive source, and unfolds the protection unit 20C such that it covers the head of the user at the time of activation. Thus, the protection device 1C can absorb an impact with the protection unit 20C and suppress damage to the head.

In addition, the protection device 1C according to the present modification can be simply configured by using the elastic force of the buffer material 23C as a drive source. Note that the buffer material 23C may have a tubular shape to cover the face of the user.

Fourth Modification

Figure 19:
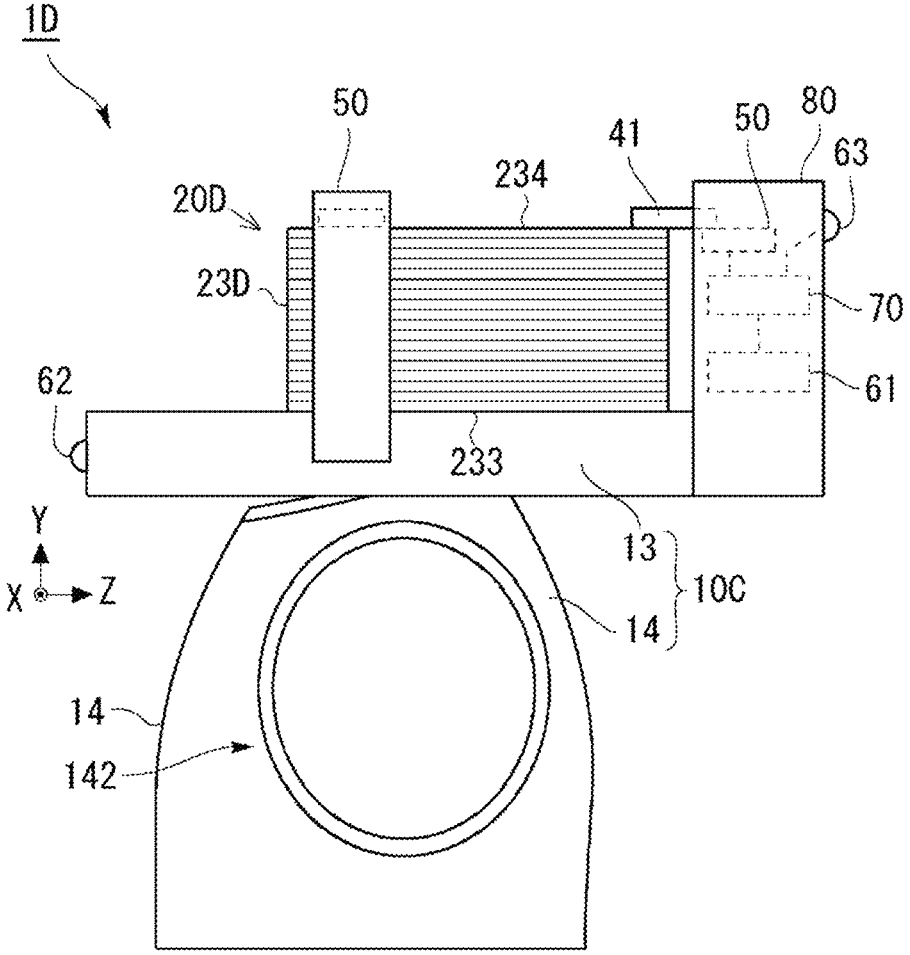
FIG. 19 is a side view of a protection device according to a fourth modification, illustrating a state in which a protection unit is in a folded orientation.
Figure 20:
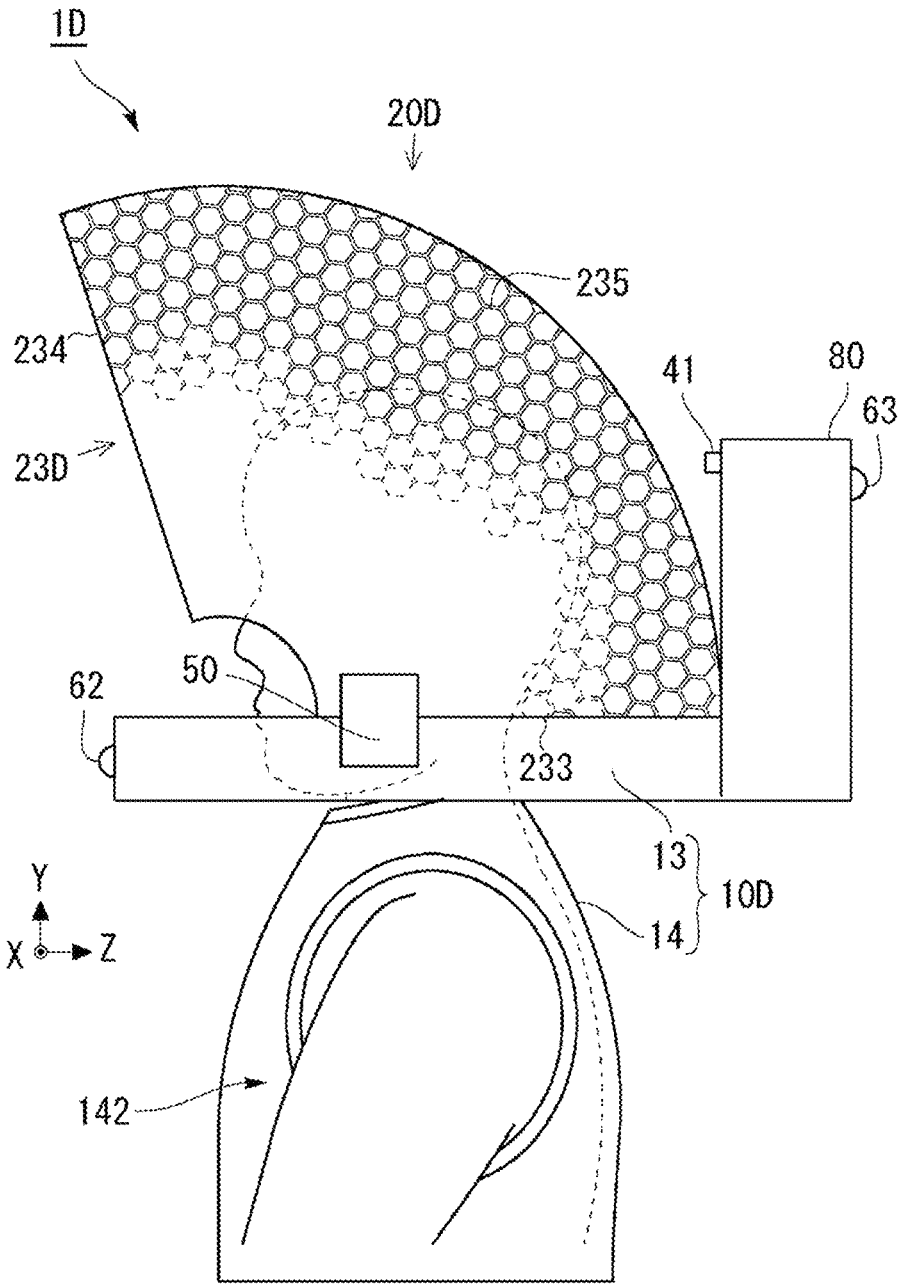
FIG. 20 is a side view of the protection device according to the fourth modification, illustrating a state in which a user wears the protection device and the protection unit is unfolded.
Figure 21:
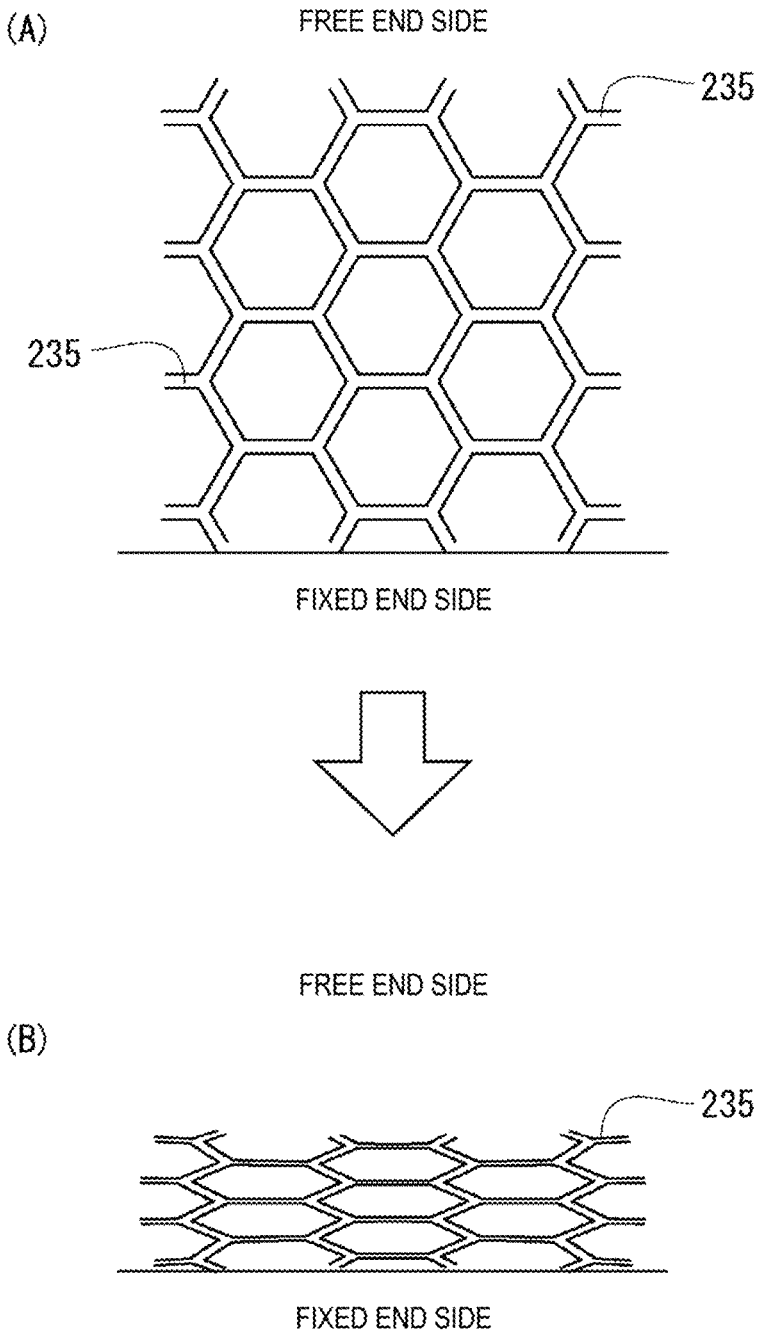
FIG. 21 is a schematic diagram illustrating an unfolded state and a folded state of a honeycomb structure.

FIG. 19 is a side view of a protection device 1D according to a fourth modification, illustrating a state in which a protection unit 20D is in a folded orientation. FIG. 20 is a side view of the protection device 1D according to the fourth modification, illustrating a state in which the user wears the protection device 1D and the protection unit 20D is unfolded. FIG. 21 is a schematic diagram illustrating an unfolded state and a folded state of a honeycomb structure.

The present modification is different from the second modification described above in that a buffer material 23D of the protection unit 20D has a honeycomb structure, and the rest of the configuration is the same. Accordingly, the same elements as those of the second modification are denoted by the same reference numerals or the like and the description thereof will not be repeated.

The buffer material 23D has a shape forming a portion of a bowl shape to cover the head of the user, and is foldable by the honeycomb structure. For example, as illustrated in FIG. 21(A), when viewed from the outer circumferential surface side or the inner circumferential surface side, the honeycomb structure has a configuration in which hexagons are filled in a plane, the boundaries of the hexagons are formed of an elastic member 235, and the hexagonal portions are cavities (cells). Note that FIG. 21 schematically illustrates the honeycomb structure for explanatory convenience, and dimensions such as the size of each cell and the thickness of the elastic member 235 do not necessarily coincide with those of the actual structure. In addition, the buffer material 23D of the present modification is formed in a substantially bowl shape, and the opening of each cell in the outer circumferential surface is formed larger than the opening of each cell in the inner circumferential surface, but this is not illustrated in FIG. 21.

In the released state, i.e., before being changed in form by application of external force, the buffer material 23D is in the unfolded orientation as illustrated in FIGS. 20 and 21(A). When the free end 234 of the protection unit 20D is brought from this state close to the fixed end 233 against the elastic force of the buffer material 23D, the cells of the buffer material 23D are linearly crushed as illustrated in FIG. 21(B), and the honeycomb structure is compressed. Thus, the protection unit 20D is brought into the folded orientation as illustrated in FIG. 19. Thus, the buffer material 23D according to the present modification is reversibly switchable between the unfolded orientation and the folded orientation by the honeycomb structure.

Note that the configuration in which the protection unit 20D is locked in the folded orientation by the lock portion 40 and the configuration in which the control unit 70 controls the trigger portion 50 in accordance with the state of the user or the state of the surroundings to release the lock portion 40 are the same as those in the second modification described above.

As described above, in the protection device 1D according to the present modification, the buffer material 23D has a honeycomb structure and is reversibly switchable between the unfolded orientation and the folded orientation. Therefore, the protection unit 20D can be returned to the folded orientation and repeatedly used even after the protection device 1D is activated. Note that the shape of the buffer material 23D is not limited to the bowl shape illustrated in FIG. 20, but may be unfolded in a gutter shape (U-shape in cross-section) or a cylindrical shape as illustrated in FIG. 18.

Fifth Modification

Figure 22:
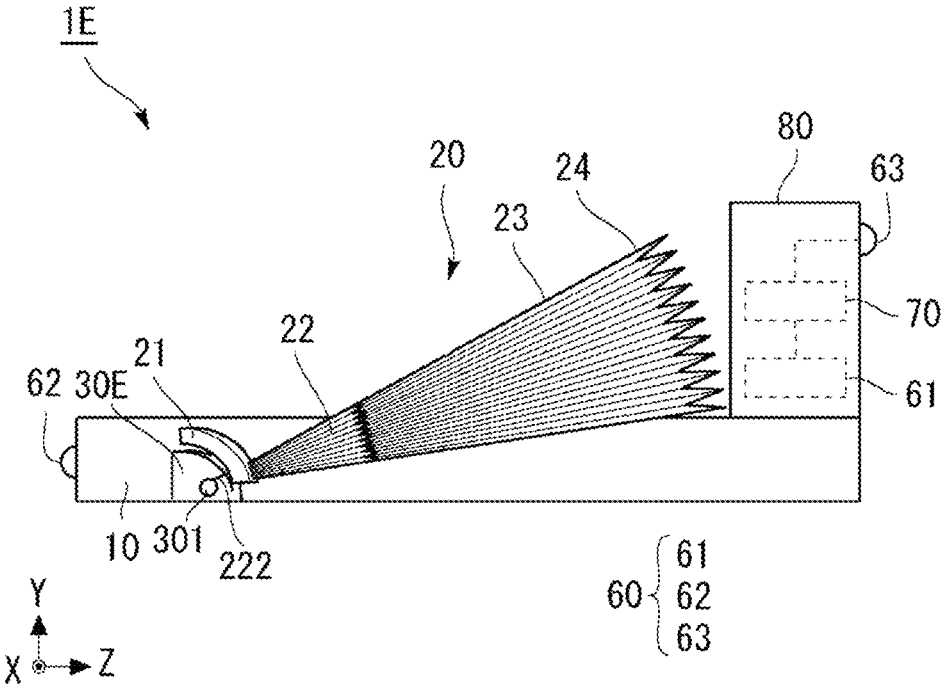
FIG. 22 is a side view of a protection device according to a fifth modification, illustrating a state in which the protection unit is in the folded orientation.
Figure 23:
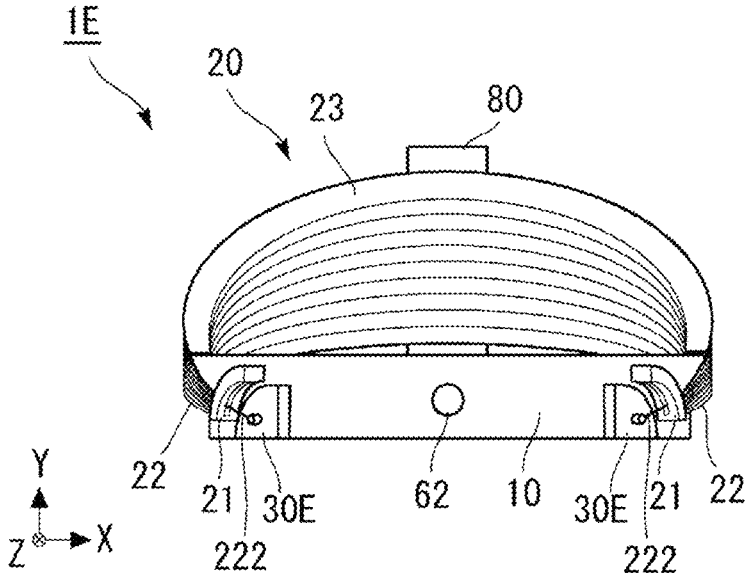
FIG. 23 is a front view of the protection device according to the fifth modification, illustrating a state in which the protection unit is in the folded orientation.
Figure 24:
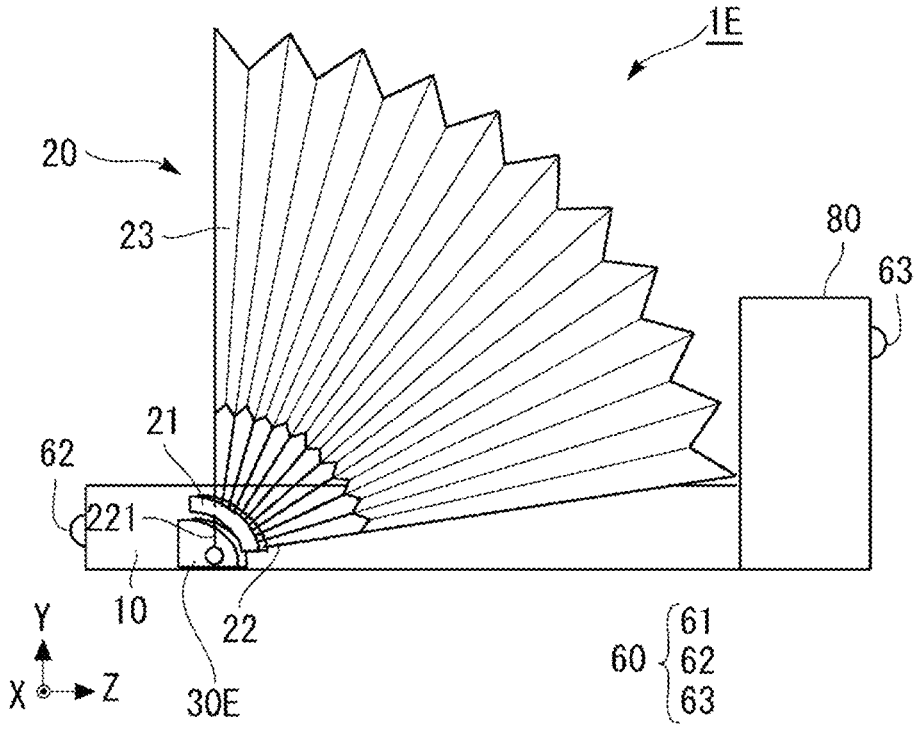
FIG. 24 is a side view of the protection device according to the fifth modification, illustrating a state in which the protection unit is unfolded.

FIG. 22 is a side view of a protection device 1E according to a fifth modification, illustrating a state in which the protection unit 20 is in the folded orientation. FIG. 23 is a front view of the protection device 1E according to the fifth modification, illustrating a state in which the protection unit 20 is in the folded orientation. FIG. 24 is a side view of the protection device 1E according to the fifth modification, illustrating a state in which the protection unit 20 is unfolded.

The present modification is different from the aforementioned embodiment in that drive portions 30E are electric actuators and the lock portion 40 and the trigger portion 50 are omitted, and the rest of the configuration is the same. Accordingly, the same elements as those of the first embodiment are denoted by the same reference numerals or the like and the description thereof will not be repeated.

The drive portions 30E are electric actuators embedded in left and right side portions of the protection device 1E, specifically, the left and right side portions of the base portion 10. The drive portions 30E each include a rotating shaft 301 that can rotationally drive. In the protection unit 20, a rib 222 disposed nearest to the free end 234 side passes through the guide rails 21 and extends to the drive portion 30E side, and the rib 222 is connected to the rotating shaft 301. The drive portions 30E drive the rotating shaft 301 to drive the ribs 222 in a direction separating from the fixed end 233, thereby unfolding the protection unit 20, and to drive the ribs 222 in a direction approaching the fixed end 233 side, thereby folding the protection unit 20.

The drive portions 30E are electrically connected to the control unit 70, and unfolding and folding of the protection unit 20 are controlled. The control unit 70 performs the processing of steps S10 to S30 in the same manner as that in FIG. 8. When Yes is selected in step S30, the control unit 70 proceeds to step S40 and drives the drive portions 30E to unfold the protection unit 20. Then, when a reset instruction is input from the user, the control unit 70 controls the drive portion 30E to bring the protection unit 20 into the folded orientation.

As described above, the protection device 1E according to the present modification can protect the head of the user by using the electric actuator as a drive source and unfolding the protection unit 20 such that it covers the head of the user at the time of activation.

In addition, since the electric actuators are used as the drive portions 30E, the protection device 1E of the present modification can omit the lock portion 40 and the trigger portion 50 and can be simply configured.

Second Embodiment

Figure 25:
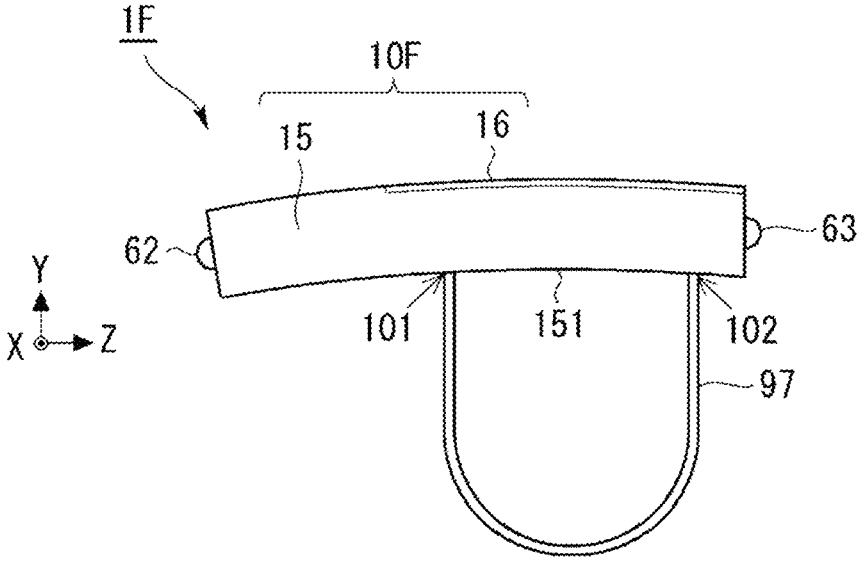
FIG. 25 is a side view of a protection device according to a second embodiment.
Figure 26:
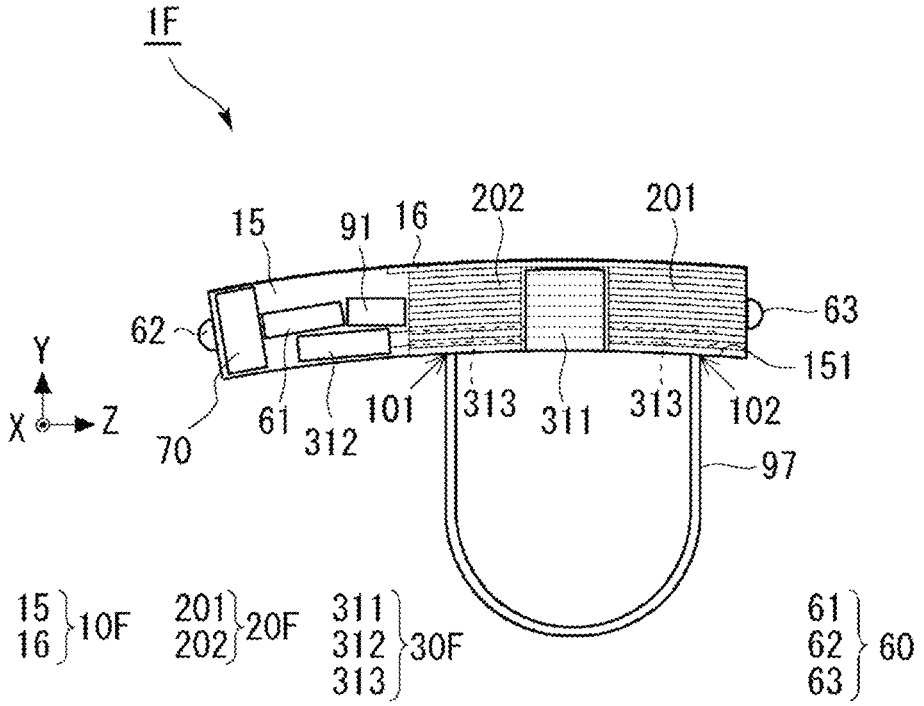
FIG. 26 is a schematic configuration diagram of the protection device according to the second embodiment.
Figure 27:
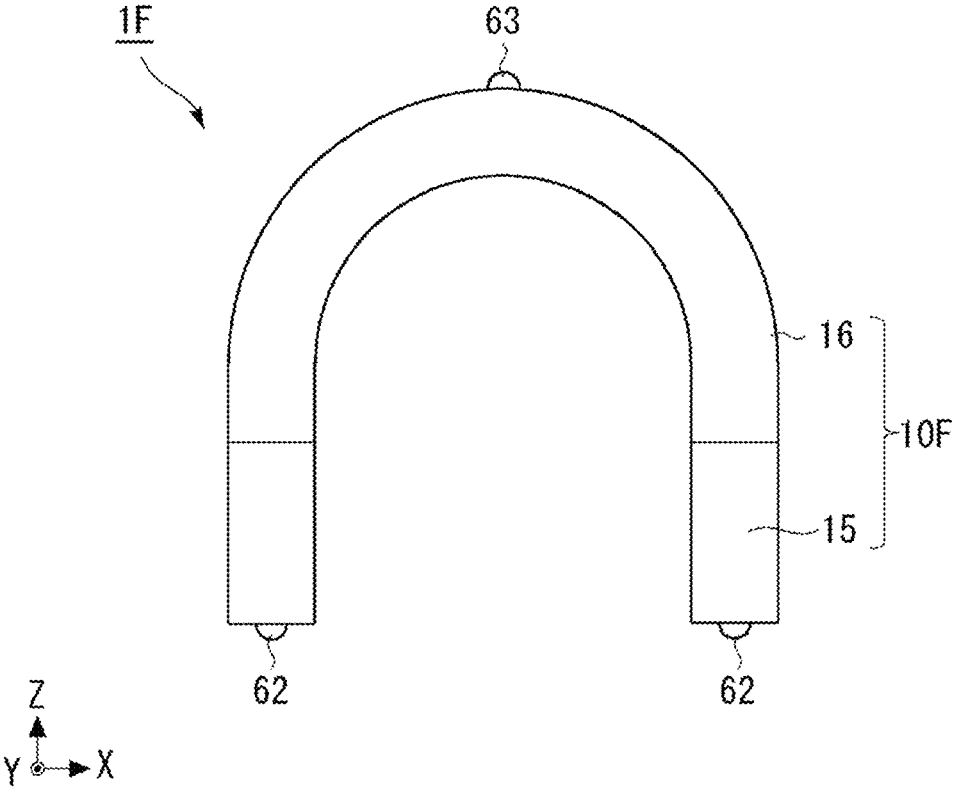
FIG. 27 is a plan view of the protection device according to the second embodiment.
Figure 28:
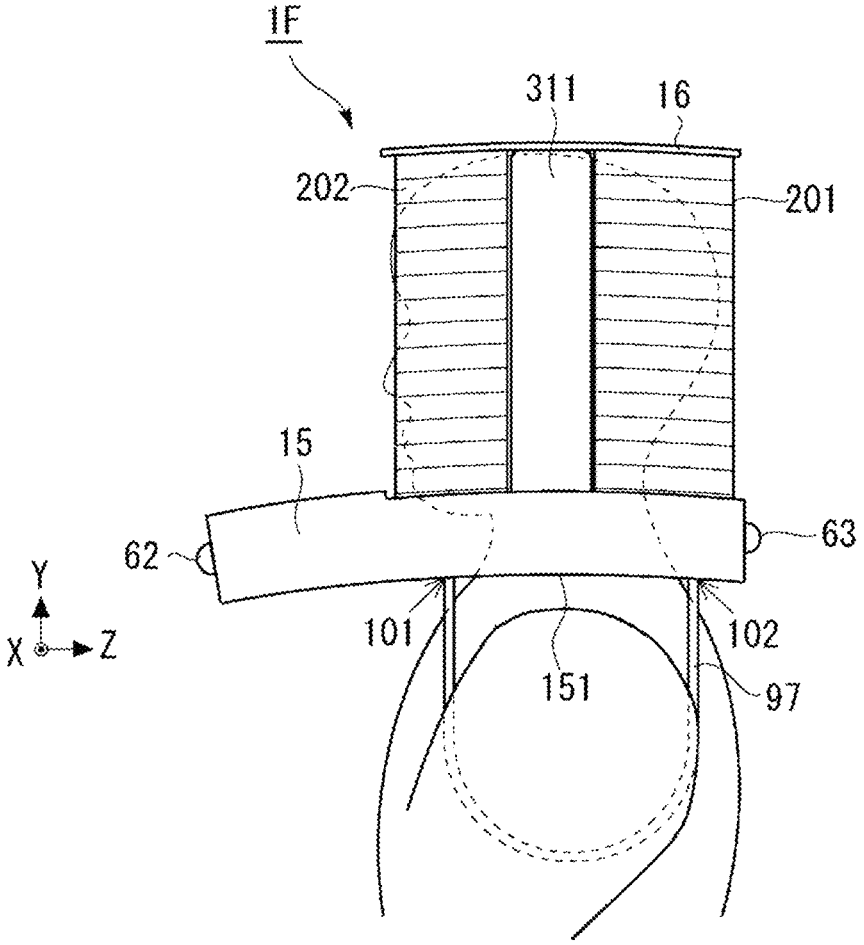
FIG. 28 is a side view of the protection device according to the second embodiment, illustrating a state where a user wears the protection device and a protection unit is unfolded.
Figure 29:
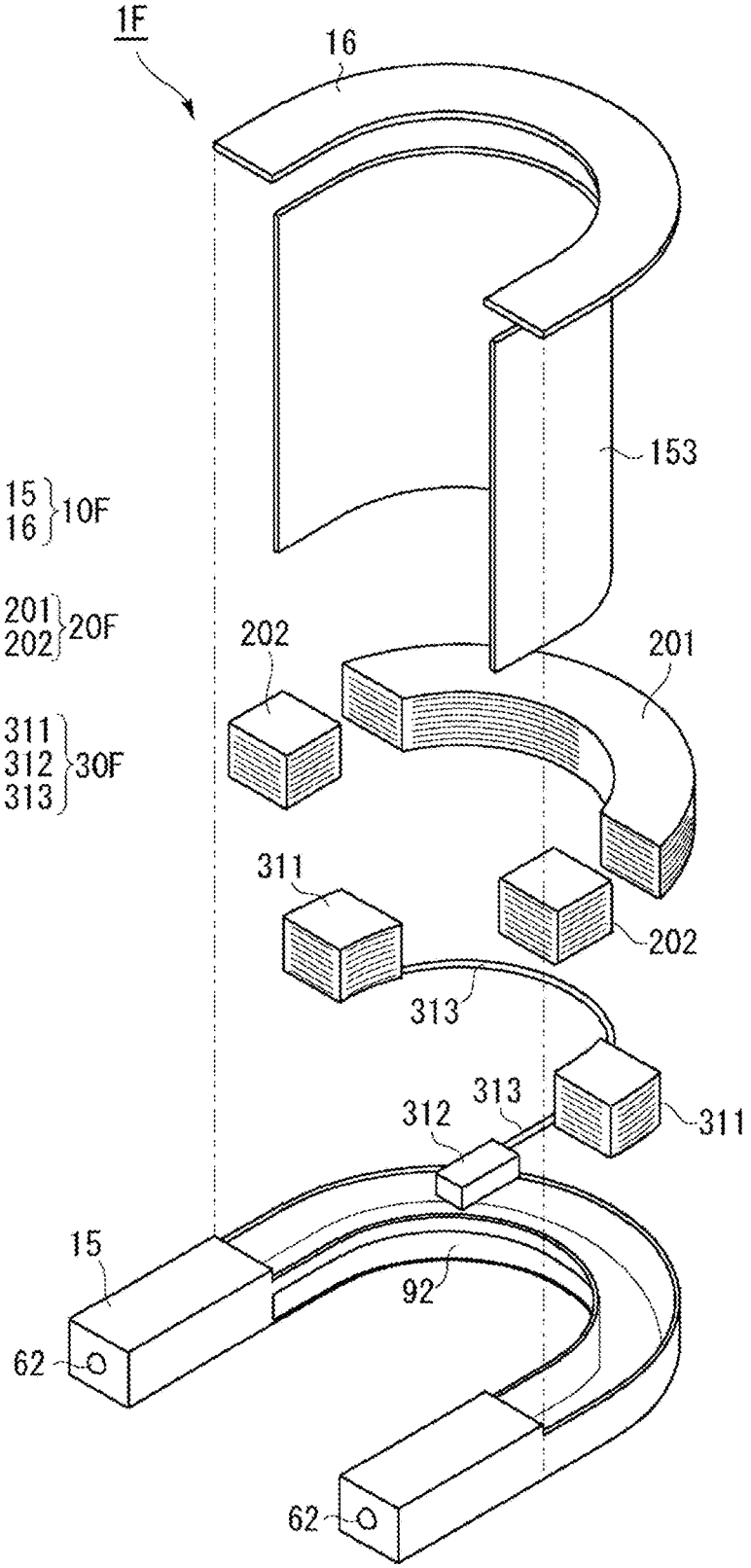
FIG. 29 is an exploded perspective view of the protection device according to the second embodiment.
Figure 30:
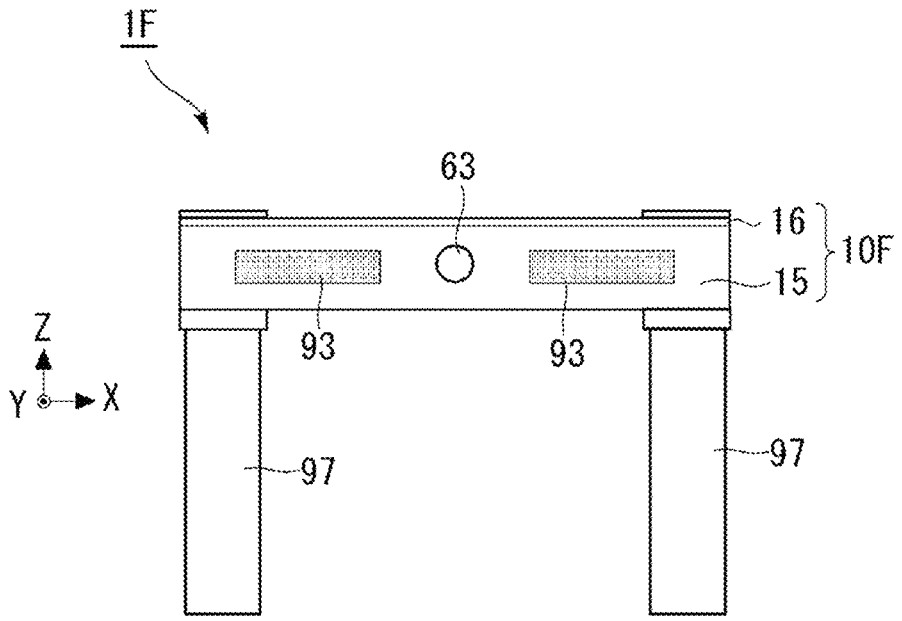
FIG. 30 is a back view of the protection device according to the second embodiment.

FIG. 25 is a side view of a protection device 1F according to a second embodiment. FIG. 26 is a schematic configuration diagram of the protection device 1F according to the second embodiment. FIG. 27 is a plan view of the protection device 1F according to the second embodiment. FIG. 28 is a side view of the protection device 1F according to the second embodiment, illustrating a state where the user wears the protection device 1F and a protection unit 20F is unfolded. FIG. 29 is an exploded perspective view of the protection device 1F according to the second embodiment. FIG. 30 is a back view of the protection device 1F according to the second embodiment. In the present embodiment, the same elements as those of the aforementioned first embodiment are denoted by the same reference numerals or the like and the description thereof will not be repeated.

The protection device 1F illustrated in FIG. 25 is worn on the body (human body) of the user and protects at least the head of the user. The protection device 1F includes a base portion 10F, the protection unit 20F, a drive portion 30F, the detection unit 60, and the control unit 70.

As illustrated in FIG. 27, the base portion 10F is an enclosure that surrounds the head of the user in a U-shape in a plan view. The base portion 10F includes a body portion 15 that houses the protection unit 20F, the drive portion 30F, the detection unit 60, the control unit 70, and a blower 91, and a top plate portion 16 that is attachable to and detachable from the body portion 15. The protection unit 20F has a bellows structure extendable and contractable in the up-down direction, and includes a first protection portion 201 disposed at a rear portion of the base portion 10F and second protection portions 202 disposed at two positions, left and right positions, in front of the first protection portion 201. One end (a fixed end) of each of the first protection portion 201 and the second protection portions 202 is connected to a bottom plate 151 of the body portion 15, and the other end (a free end) thereof is connected to a lower surface of the top plate portion 16.

The drive portion 30F includes airbags 311, a gas generator 312, and an air supply pipe 313. The airbags 311 are each formed having a columnar shape when being unfolded. The airbag 311 is disposed between the first protection portion 201 and the second protection portion 202. Additionally, one end (a fixed end) of the airbag 311 is connected to the bottom plate 151 of the body portion 15, and the other end (a free end) thereof is connected to the lower surface of the top plate portion 16. The drive portion 30F before activation is folded and housed in the base portion 10F.

The gas generator 312 is connected to the airbags 311 via the air supply pipe 313, and supplies gas to the airbags 311 at the time of activation under the control by the control unit 70. The gas generator 312 generates combustion gas, for example, by burning powder at the time of activation. Note that the gas generator 312 is not limited to such a configuration, and may be any device that generates gas to unfold the airbags 311, such as a device that holds compressed gas and releases compressed gas at the time of activation.

A cover portion 153 (FIG. 29) that covers the protection unit 20F and the airbags 311 when the protection unit 20F and the airbags 311 are brought into the unfolded orientation is disposed on an inner peripheral wall side of the protection unit 20F and the airbags 311. One end (a fixed end) of the cover portion 153 is connected to the bottom plate 151 of the body portion 15, and the other end (a free end) thereof is connected to the lower surface of the top plate portion 16. The cover portion 153 is housed in a folded or contracted state in the base portion 10F in an initial state, that is, in a state before the protection device 1F is activated. The cover portion 153 is unfolded together with the protection unit 20F and the airbags 311 when the protection device 1F is activated.

The acceleration sensor 61 is disposed as the first detection unit 60 in the base portion 10F, the cameras 62 are disposed as the second detection units 60 at front side portions of the base portion 10F, and the camera 63 is disposed as the third detection unit 60 at a rear portion of the base portion 10F.

The blower 91 sends the outside air taken in from the bottom plate side of the base portion 10F to the rear side in the base portion 10F, and discharges the air from a ventilation hole (not illustrated) disposed in an inner peripheral wall (a peripheral wall on the side where the head is located) of the body portion 15 to cool the circumference of the neck of the user. The blower 91 is turned on/off by an operation of the user. In addition, the control unit 70 may detect the outside air temperature from the temperature sensor (detection unit 60) and operate the blower 91 when it is determined that the outside air temperature is equal to or higher than a predetermined value. Also, a heater 92 (FIG. 29) is disposed along the inner peripheral wall of the body portion 15. The heater 92 is turned on/off by an operation of the user. In addition, the control unit 70 may detect the outside air temperature from the temperature sensor (detection unit 60), operate the heater 92 when it is determined that the outside air temperature is below a predetermined value, and control the heater 92 such that a target temperature set by the user is reached. Also, a reflector plate 93 is disposed on an outer peripheral surface such as a side surface or a back surface of the base portion 10F. In the present embodiment, a plurality of reflector plates 93 are disposed on the back surface of the base portion 10F as illustrated in FIG. 30.

Belts (fixing portions) 97 that fix the base portion 10F to the human body are disposed at a lower portion of the base portion 10F. Both ends of each of the belts 97 at two portions on the left and right of the base portion 10F are connected to a front side portion 101 of the base portion 10F and a rear side portion 102 separated from the front side portion 101. In other words, the bottom plate 151 of the base portion 10F and each of the belts 97 form a loop, and the arms of the user are passed through the loops formed using the left and right belts 97. The belts 97 are extended under the armpits of the user, and thus the base portion 10F is fixed to the user. Note that the fixing portion is not limited to the belts 97, and may be the jacket portion 14 as in the second modification. The fixing portion may be a fastener or a button, and may be fixed to a jacket worn by the user with the fastener or the button. For example, in a jacket to and from which a hood is attachable and detachable by a fastener, the hood may be detached from the jacket and the protection device 1F may be attached instead.

The control unit 70 determines, as in the first embodiment described above, whether to activate the protection device 1F depending on whether the information indicating the state of the user and the state of the surroundings satisfies a predetermined condition. The control unit 70 activates the gas generator 312 when the predetermined condition is satisfied. The activated gas generator 312 supplies gas to the airbags 311 via the air supply pipe 313. The airbags 311 supplied with the gas unfold extending the free end upward with respect to the fixed end and push up the top plate portion 16 of the base portion 10F. Accordingly, the free end of the protection unit 20F connected to the top plate portion 16 moves upward, and then the protection unit 20F is unfolded. In this case, a direct contact of the head of the user with the protection unit 20F is avoided by the cover portion 153, and an impact on the head is further relieved. The cover portion 153 is not necessarily disposed only between the head of the user and the protection unit 20F, and may be disposed covering the entire protection unit 20F. Note that the airbags 311 and the protection unit 20F that have been unfolded may be folded and housed in the base portion 10F by the user for reuse. In addition, the airbags 311 and the gas generator 312 may be of a cartridge type, and may be replaced with an unused airbag 311 and an unused gas generator 312 after activation and thus may be reusable.

As described above, according to the present embodiment, when the user falls down, when the user is likely to be hit by a vehicle, or when the user is predicted to receive an impact, the protection device 1F unfolds the protection unit 20F and thus it covers the head of the user. Consequently, the protection device 1F can absorb the impact on the head with the protection unit 20F and protect the head of the user.

Further, since the protection device 1F of the present embodiment is worn by the user with the belts 97, the protection device 1F is prevented from being detached at the time of a collision, and security can be improved. Furthermore, since the protection device 1F of the present embodiment includes the blower 91 and the heater 92, temperature is adjusted, and thus comfort of the user can be improved. In addition, since the protection device 1F of the present embodiment includes the reflector plates on the peripheral wall of the base portion 10F, the light of a vehicle is reflected to be easily recognized by drivers around the vehicle, and thus security can be improved. Note that the blower 91, the heater 92, and the reflector plates 93 may be disposed in the protection devices of the aforementioned first embodiment and the aforementioned modifications.

Third Embodiment

Figure 31:
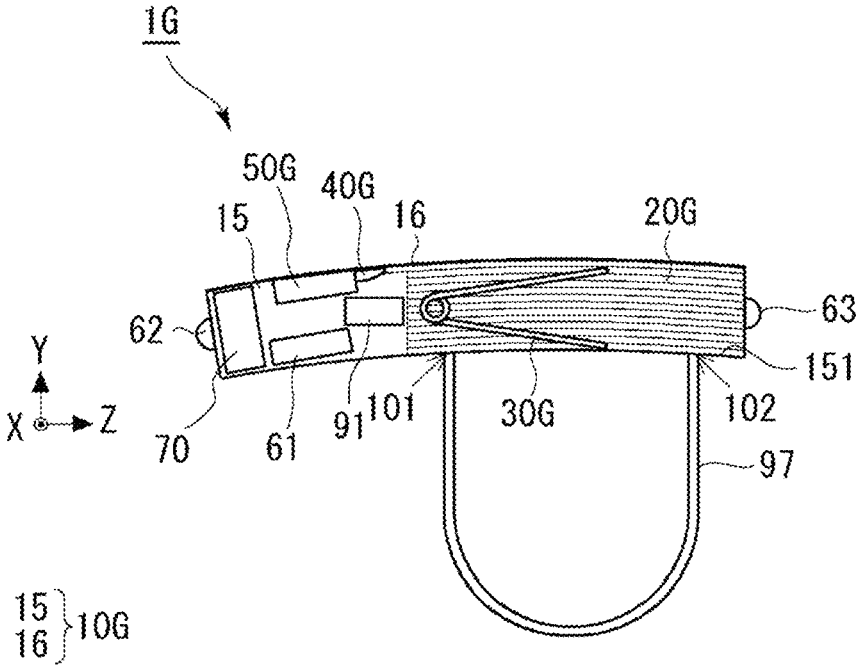
FIG. 31 is a schematic configuration diagram of a protection device according to a third embodiment.
Figure 32:
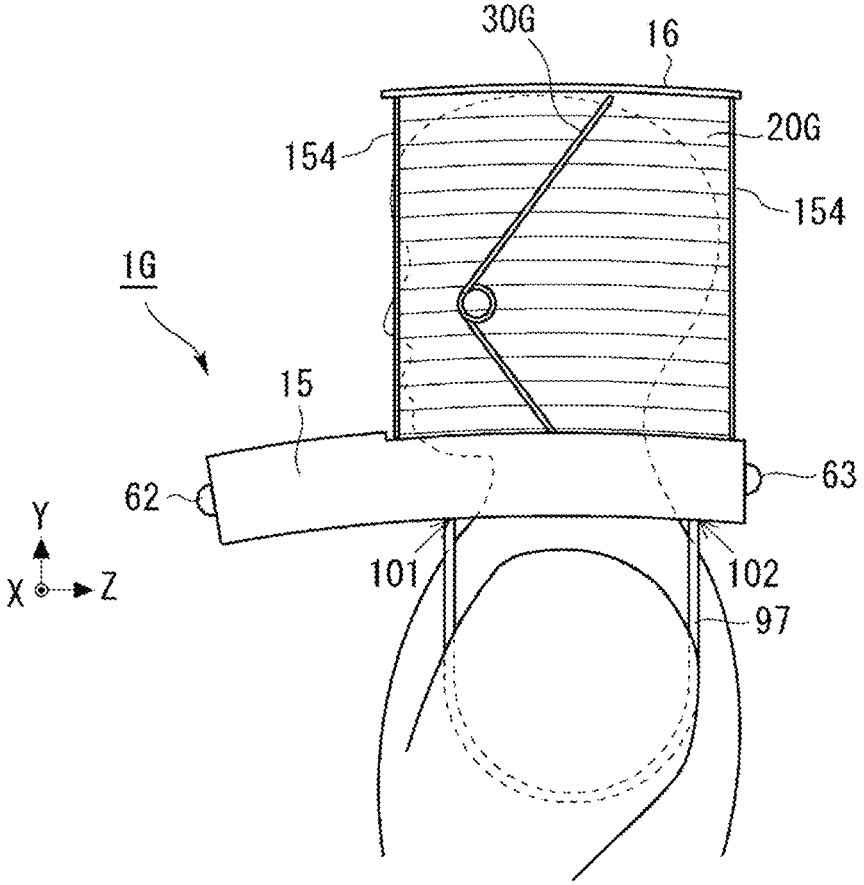
FIG. 32 is a side view of the protection device according to the third embodiment, illustrating a state where a user wears the protection device and a protection unit is unfolded.
Figure 33:
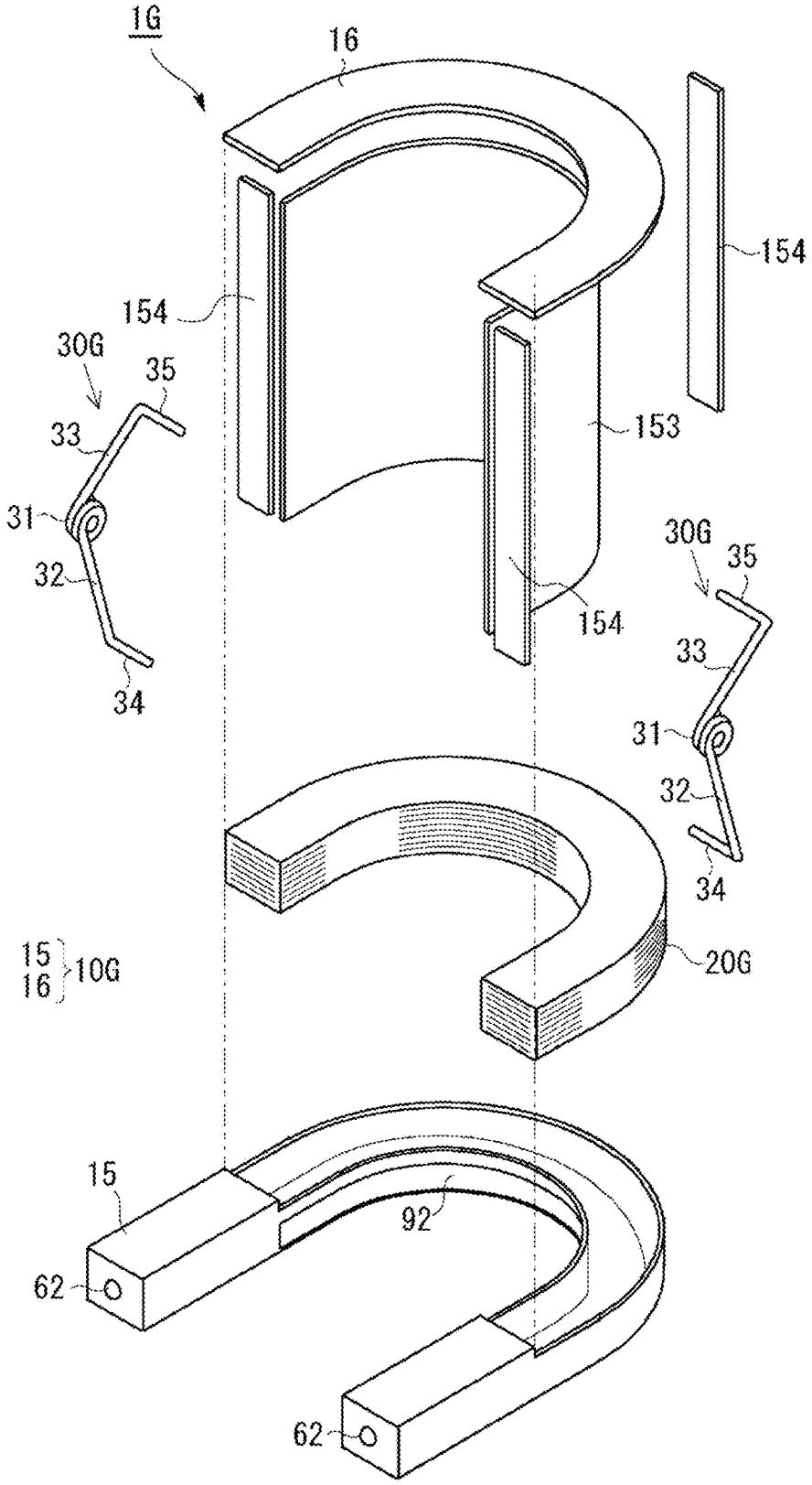
FIG. 33 is an exploded perspective view of the protection device according to the third embodiment.
Figure 34:
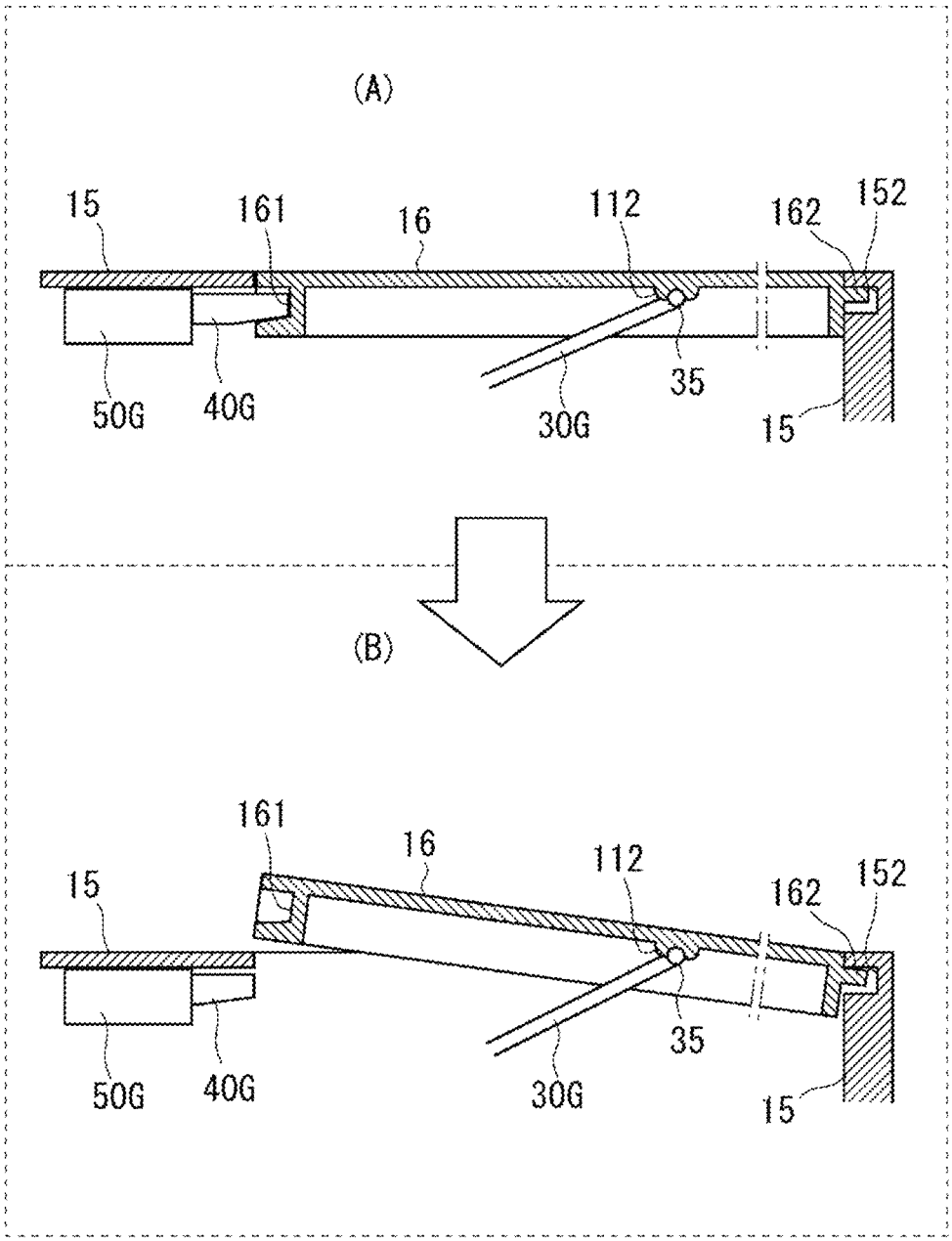
FIG. 34 is a schematic diagram illustrating the configuration for unfolding the protection unit according to the third embodiment.

FIG. 31 is a schematic configuration diagram of a protection device 1G according to a third embodiment. FIG. 32 is a side view of the protection device 1G according to the third embodiment, illustrating a state where the user wears the protection device 1G and a protection unit 20G is unfolded. FIG. 33 is an exploded perspective view of the protection device 1G according to the third embodiment. FIG. 34 is a schematic diagram illustrating the configuration for unfolding the protection unit 20G according to the third embodiment. The present embodiment is substantially the same as the aforementioned second embodiment except in the configuration of unfolding the protection unit 20G. Accordingly, the same elements as those of the second embodiment are denoted by the same reference numerals or the like and the description thereof will not be repeated.

A base portion 10G is an enclosure that surrounds the head of the user in a U-shape in a plan view in the same way as the base portion 10F of FIG. 27. The base portion 10G includes the body portion 15 that houses the protection unit 20G, drive portions 30G, lock portions 40G, trigger portions 50G, and the control unit 70, and the top plate portion 16 that is attachable to and detachable from the body portion 15. The protection unit 20G is formed in a U-shape in a plan view and has a bellows structure extendable and contractable in the up-down direction. One end (a fixed end) of the protection unit 20G is connected to the bottom plate 151 of the body portion 15, and the other end (a free end) thereof is connected to the lower surface of the top plate portion 16.

The cover portion 153 that covers the protection unit 20G when the protection unit 20G is brought into the unfolded orientation is disposed on an inner peripheral wall side of the protection unit 20G. One end (a fixed end) of the cover portion 153 is connected to the bottom plate 151 of the body portion 15, and the other end (a free end) thereof is connected to the lower surface of the top plate portion 16. The cover portion 153 is housed in a folded or contracted state in the base portion 10G in an initial state, that is, in a state before the protection device 1G is activated. The cover portion 153 is unfolded together with the protection unit 20G when the protection device 1G is activated.

In addition, restriction portions 154 that restrict the extension length of the protection unit 20G, in other words, the moving distance of the free end are disposed on the front side and the rear side of the protection unit 20G. The restriction portions 154 are each a sheet formed of an inextensible material to have a predetermined length. One end of the restriction portion 154 is connected to the free end side of the protection unit 20G via the top plate portion 16, and the other end of the restriction portion 154 is connected to a bottom plate of the base portion 10G. Thus, the distance by which the top plate portion 16 is separated from the bottom plate of the base portion 10G is restricted, and the moving distance of the free end of the protection unit 20G is also restricted. Note that the cover portion 153 may also function as the restriction portion 154 (in a case where a non-stretchable material is used for the cover portion 153).

The drive portions 30G of the present embodiment are so-called torsion springs, and each include an arm portion 32 extending from one end of a coil portion 31, an arm portion 33 extending from the other end of the coil portion 31, and connecting portions 34, 35 extending from tips of the respective arm portions 32, 33 in a direction along the center axis of the coil portion 31. The connecting portion 34 of the drive portion 30G is connected to a bottom plate side connecting portion of the base portion 10G, and the connecting portion 35 of the drive portion 30G is connected to a top plate side connecting portion 112 (FIG. 34) disposed on the top plate portion 16. Note that the drive portions 30G are not limited to the torsion springs, and may be elastic members having elastic force that allows the protection unit 20G to be unfolded, such as a spring having another shape.

The lock portion 40G is disposed adjacent to the front side of the top plate portion 16 in the body portion 15, and locks the top plate portion 16 by engaging with the top plate portion 16 in a state where the top plate portion 16 is attached to the body portion 15 (in a closed state). The trigger portions 50G are drive portions that are connected to the lock portions 40G and drive the lock portions 40G. For example, the trigger portions 50G are electric actuators. The trigger portions 50G move the lock portions 40G forward and backward in accordance with the control by the control unit 70 and thus lock the top plate portion 16 or release the lock of the top plate portion 16.

FIG. 34(A) illustrates an initial state of the protection device 1G, that is, a state in which the protection unit 20G is housed in the folded orientation in the base portion 10G and the top plate portion 16 is closed, and FIG. 34(B) illustrates a state at the time of activation, that is, a state in which the top plate portion 16 is opened and the protection unit 20G starts to unfold. In the initial state, the lock portion 40G is engaged with a front engagement portion (recessed portion) 161 of the top plate portion 16 and presses the top plate portion 16 rearward, and thus a rear engagement portion (protruded portion) 162 disposed on a rear portion of the top plate portion 16 is engaged with a body side engagement portion 152 disposed in the body portion 15. In this case, the drive portion 30G is housed in a compressed state between the bottom plate and the top plate portion 16 of the base portion 10G.

Then, the control unit 70 determines, as in the second embodiment described above, whether to activate the protection device 1G depending on whether the information indicating the state of the user and the state of the surroundings satisfies a predetermined condition. The control unit 70 activates the trigger portions 50G when the predetermined condition is satisfied. In the example of FIG. 34, the trigger portion 50G moves the lock portion 40G backward, thereby releasing the engagement between the lock portion 40G and the front engagement portion 161 of the top plate portion 16 and the engagement between the rear engagement portion 162 of the top plate portion 16 and the body side engagement portion 152. As a result, the top plate portion 16 becomes movable, and the top plate portion 16 is pushed upward by the elastic force of the drive portion 30G. Accordingly, the free end of the protection unit 20G connected to the top plate portion 16 moves upward, and the protection unit 20G is unfolded.

As described above, according to the present embodiment, when the user falls down, when the user is likely to be hit by a vehicle, or when it is predicted that the user will receive an impact, the protection device 1G unfolds the protection unit 20G and thus it covers the head of the user. Consequently, the protection device 1G can absorb the impact on the head with the protection unit 20G and protect the head of the user.

In addition, according to the present embodiment, the restriction portions 154 restrict the extension length of the protection unit 20G to a predetermined length. Thus, the protection unit 20G can be prevented from being excessively extended to cause deterioration of protection performance, and reliability can be improved.

Others

The protection device of the present application is not limited to the configurations of the embodiments described above and the modifications described above. The protection device may be varied as appropriate by combining the aforementioned elements or omitting some of the elements. For example, in the aforementioned embodiments and modifications, the control unit 70 determines an emergency situation and controls the trigger portion 50 to unfold the protection units 20 to 20D, but is not limited thereto. The user may manually release the lock portion 40 to activate the protection device. In this case, the trigger portions 50, the detection unit 60, and the control unit 70 can be omitted, and the protection device can be simply configured. Additionally, in the aforementioned embodiments and modifications, the protection unit is unfolded by the elastic force of the drive portion or the buffer material, but no such limitation is intended. The user may manually unfold the protection unit to activate the protection device. In this case, the drive portion 30 and the lock portion 40 can be omitted, and the protection device can be further simplified. Alternatively, such a configuration may be combined with the devices illustrated in FIGS. 1 to 23.

REFERENCE SIGNS LIST

1, 1A, 1B, 1C, 1D, 1E, 1F, 1G Protection device
2X Rotation axis
10, 10B, 10F, 10G Base portion
11 Inner space
12 Lower surface
13 Neck enclosure
14 Jacket portion
17 Control unit
20, 20A, 20C, 20D, 20F, 20G Protection unit
21 Guide rail
22 Rib
23, 23A, 23C, 23D Buffer material
24, 24A, 24C Presser plate
30, 30E, 30F, 30G Drive portion
40, 40G Lock portion
50, 50G Trigger portion
60 Detection unit
70 Control unit
71 Processor
72 Storage unit
73 Input/output unit
80 Rear enclosure
141 First hole portion
142 Second hole portion
211 Groove
221 Left and right end portions
231 Crest portion
232 Trough portion
233 Fixed end
234 Free end

235 Elastic member
721 Main storage unit
722 Auxiliary storage unit

The invention claimed is:

1. A protection device, comprising:
a base portion attachable to a human body; and
a protection unit, including:
a fixed end fixed to the base portion, a free end, and a drive portion; and
a bellows structure fixed to the fixed end and the free end, and coupled to the drive portion;
a lock portion configured to selectively lock the protection unit in a folded orientation; and
a trigger portion engaged to the lock portion and configured to unlock the lock portion by releasing the lock portion from the trigger portion to cause the protection unit to be unfolded by the elastic force of the drive portion,
wherein in the folded orientation, the bellows structure of the protection unit is folded in a state where the free end is adjacent to the fixed end, and the drive portion is compressed toward the fixed end, the free end being elastically biased with the elastic force of the drive portion toward the fixed end, and
wherein in the unfolded orientation, the protection unit is unfolded around the head of the human body with a corrugated shape while the free end moves from the fixed end by the elastic force of the drive portion, at a time of switching from the folded orientation to the unfolded orientation based on that the trigger portion releases the lock portion.

2. The protection device according to claim 1, further comprising:
a detection unit configured to detect a state of the human body or a state around the human body; and
a control unit configured to acquire a detection result by the detection unit and control the trigger portion to release the protection unit locked by the lock portion when the detection result satisfies a predetermined condition.

3. The protection device according to claim 2, wherein the detection unit includes at least one sensing unit selected from an acceleration sensor, a gyro sensor, a positioning device, a camera, a radar, a Laser Detection and Ranging system (LIDAR), and a three-dimensional scanner.

4. The protection device according to claim 1, wherein the drive portion is configured to cause the protection unit to unfold by driving the free end of the protection unit in the folded orientation and thus moving the free end from the fixed end.

5. The protection device according to claim 4, further comprising:
a detection unit configured to detect a state of the human body or a state around the human body; and
a control unit configured to acquire a detection result by the detection unit and control the drive portion to cause the drive portion to operate when the detection result satisfies a predetermined condition.

6. The protection device according to claim 1, wherein the free end of the protection unit rotates about a straight line at a predetermined position as a rotation center to reversibly change an orientation thereof between the folded orientation before activation and the unfolded orientation after activation.

7. The protection device according to claim 6, wherein
the protection unit is formed of a buffer material having a buffering function, and the buffer material has a bellows shape in which a rib is attached to a crest portion of the buffer material, and
the rib is bridged between guide rails disposed on left and right side surfaces of the base portion and provided with grooves, and left and right end portions of the rib are slidably attached to the grooves.

8. The protection device according to claim 6, wherein the base portion is an enclosure that surrounds the head of the human body in a U-shape in a plan view and the protection unit is formed in the U-shape in the plan view.

9. The protection device according to claim 1, wherein the base portion is used in a state where a lower surface thereof is in contact with shoulders of the human body and the base portion is disposed around a neck of the human body.

10. The protection device according to claim 1, wherein the protection unit is formed of a buffer material having a buffering function, and the buffer material also covers a face of the human body when the protection unit is activated and brought into the unfolded orientation.

11. The protection device according to claim 10, wherein the buffer material is the drive portion.

12. The protection device according to claim 1, further comprising a fixing portion configured to fix the base portion to the human body.

13. The protection device according to claim 1, further comprising a cover portion configured to cover at least a surface of the protection unit that is located on a side of the head, when the protection unit is brought into the unfolded orientation.

14. A protection device, comprising:
a base portion attachable to a human body;
an drive portion;
a protection unit having a bellows structure, held by the base portion, and being switchable between a folded orientation in which the protection unit is folded and an unfolded orientation in which the protection unit is unfolded from the folded orientation by an elastic force of the drive portion elastically biased to the unfolded orientation and thus the protection unit covers the head of the human body, the protection unit being provided with a fixed end fixed to the base portion and a free end not fixed to the base portion;
a lock portion configured to lock the protection unit in a folded orientation against the elastic force of the drive portion;
a trigger portion engaged to the lock portion and configured to selectively unlock the protection unit locked by the lock portion by releasing the lock portion from the trigger portion to cause the protection unit to be unfolded by the elastic force of the drive portion,
the protection unit being folded in a state where the free end is adjacent to the fixed end in the folded orientation and elastically biased with the elastic force to the unfolded orientation, and
the protection unit being unfolded upward to form a gutter shape while the free end, as a whole, moves from the fixed end by the elastic force biased to the unfolded orientation, at a time of switching from the folded orientation to the unfolded orientation based on that the lock portion is released from the trigger portion.

15. The protection device according to claim 14, further comprising a restriction portion including one end connected to a side of the free end of the protection unit and the other end connected to the base portion, the restriction portion being configured to restrict a moving distance of the free end.

16. The protection device according to claim 14, further comprising the drive portion configured to cause the protection unit to unfold by driving the free end of the protection unit in the folded orientation and thus moving the free end from the fixed end, wherein the drive portion is a spring, and one end thereof is connected to the base portion and the other end thereof is connected to a side of the free end of the protection unit.

17. The protection device according to claim 14, further comprising a cover portion configured to cover at least a surface of the protection unit that is located on a side of the head, when the protection unit is brought into the unfolded orientation, wherein the cover portion is formed of a non-stretchable material and functions as a restriction portion.

18. The protection device according to claim 14, wherein the protection unit is formed of a buffer material having a buffering function, and the buffer material has a bellows shape in which a rib is attached to a crest portion of the buffer material, and wherein the buffer portion is the drive portion.

* * * * *